US008208835B2

(12) United States Patent
Kabata et al.

(10) Patent No.: US 8,208,835 B2
(45) Date of Patent: Jun. 26, 2012

(54) PROTECTIVE LAYER FORMING DEVICE, IMAGE FORMING APPARATUS, AND PROCESS CARTRIDGE

(75) Inventors: Toshiyuki Kabata, Yokohama (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 390 days.

(21) Appl. No.: 12/646,437

(22) Filed: Dec. 23, 2009

(65) Prior Publication Data

US 2010/0178073 A1 Jul. 15, 2010

(30) Foreign Application Priority Data

Jan. 15, 2009 (JP) ..... 2009-006639

(51) Int. Cl.

| | |
|---|---|
| ***G03G 21/16*** | (2006.01) |
| ***G03G 15/02*** | (2006.01) |
| ***G03G 15/00*** | (2006.01) |
| ***G03G 21/00*** | (2006.01) |
| ***B05C 1/06*** | (2006.01) |

(52) U.S. Cl. ..... 399/159; 399/111; 399/116; 399/346; 399/353; 118/258

(58) Field of Classification Search ..... 399/111, 399/116, 117, 159, 161, 343, 346; 118/258
See application file for complete search history.

(56) References Cited

U.S. PATENT DOCUMENTS

| | | | |
|---|---|---|---|
| 3,501,294 | A | 3/1970 | Joseph |
| 7,218,879 | B2 | 5/2007 | Enoki et al. |
| 7,315,711 | B2 | 1/2008 | Ariizumi et al. |
| 7,486,914 | B2 | 2/2009 | Kabata et al. |
| 2007/0224528 | A1 | 9/2007 | Yamashita et al. |
| 2008/0063433 | A1* | 3/2008 | Miyamoto et al. ..... 399/252 |
| 2008/0220355 | A1* | 9/2008 | Kamoi et al. ..... 430/66 |
| 2008/0226365 | A1 | 9/2008 | Hatakeyama et al. |
| 2008/0253801 | A1 | 10/2008 | Hatakeyama et al. |
| 2009/0003853 | A1 | 1/2009 | Hatakeyama et al. |
| 2009/0016769 | A1 | 1/2009 | Hatakeyama et al. |
| 2009/0279930 | A1 | 11/2009 | Kabata et al. |

FOREIGN PATENT DOCUMENTS

| | | |
|---|---|---|
| JP | 51-22380 | 7/1976 |
| JP | 10-279998 | 10/1998 |
| JP | 2000-319224 | 11/2000 |
| JP | 2002-82515 | 3/2002 |
| JP | 2005-275166 | 10/2005 |
| JP | 2008-224828 | 9/2008 |

* cited by examiner

*Primary Examiner* — David Gray
*Assistant Examiner* — Joseph S Wong
(74) *Attorney, Agent, or Firm* — Oblon, Spivak, McClelland, Maier & Neustadt, L.L.P.

(57) ABSTRACT

A protective layer forming device including: a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of fine powder, and the protective agent in the form of fine powder is supplied onto the photoconductor, thereby forming a protective layer on the photoconductor, and wherein the protective agent in the form of fine powder has a particle diameter of 200 μm or smaller and contains protective agent particles of 20 μm to 200 μm in an amount of 1% by mass to 70% by mass.

8 Claims, 5 Drawing Sheets

PROTECTIVE LAYER FORMING DEVICE, IMAGE FORMING APPARATUS, AND PROCESS CARTRIDGE

BACKGROUND OF THE INVENTION

1. Field of the Invention

The present invention relates to a protective layer forming device which forms a protective layer containing a protective agent on a surface of a photoconductor, and also relates to an image forming apparatus using the protective layer forming device, and a process cartridge using the protective layer forming device.

2. Description of the Related Art

In an image forming apparatus utilizing electrophotographic process, image formation is carried out by subjecting a photoconductor to a charging step, an exposing step, a developing step and transferring step. Subsequently, discharge products which are generated in the charging step and remaining on the photoconductor surface, and toner residues or toner components remaining on the photoconductor surface after the transferring step are removed through a cleaning step.

As a cleaning system commonly used in the cleaning step, a rubber-made cleaning blade which is less expensive and superior in cleanability and has a simple mechanism is used. The cleaning blade, however, is press-contacted to a surface of a photoconductor so as to remove residues on the photoconductor surface, and thus a large mechanical stress is caused by friction between the photoconductor surface and the cleaning blade, the cleaning blade is abraded, in particular, in an organic photoconductor, its surface layer is abraded, undesirably, shortening the operating life of the cleaning blade and the organic photoconductor (OPC).

Toners for use in image formation have become smaller in size in response to demands for obtaining higher quality of images. In an image forming apparatus using such a toner having small particle diameter, the toner residues frequently pass through a cleaning blade, and in particular when the dimensional accuracy of a cleaning blade and assembling accuracy of the cleaning blade are insufficient or a part of the cleaning blade vibrates, toner slippage occurs at very high rate. This problem has been preventing the formation of high-quality images.

In order to prolong the operating life of an organic photoconductor and maintain high image quality, it is necessary to reduce deterioration of members, such as cleaning blades and photoconductors, caused by friction therebetween, and to improve the cleanability.

To meet the above-mentioned demands, for example, Japanese Patent Application Publication No. (JP-B) No. 51-22380 proposes a method in which a brush etc. is pressed against a protective agent block containing zinc stearate and the like to be micronized, the micronized protective agent is supplied onto a photoconductor, and a protective layer is formed by use of a cleaning blade.

This proposal is very favorable, because with use of a metal soap such as zinc stearate makes it possible to improve the lubricity of the photoconductor surface, reduce friction between the photoconductor and the cleaning blade and to improve the cleanability of the photoconductor surface, i.e., removability of untransferred toner residues.

Recently, in a charging step, a so-called AC charge has become frequently used, in which an alternating voltage is superposed on a direct voltage for charging a photoconductor surface by a charging roller. This AC charge causes fewer occurrences of oxidized gasses such as ozone and NOx, and has excellence in that a charging device can be downsized. In contrast, several hundreds times per second to several thousands times per second of negative/positive discharges are repeated between the charging member and the photoconductor, according to the frequency of the alternating voltage applied, and thus the surface layer of the photoconductor suffers from a number of discharges, and deterioration thereof is accelerated. To avoid the deterioration, a protective agent containing metal soap is applied onto a photoconductor, and the energy of AC charge is absorbed to the protective agent first, but hardly reaches the photoconductor, and thereby the photoconductor surface can be protected.

However, a protective agent containing metal soap is decomposed by energy of AC charge, but the metal soap is not completely decomposed to be distinguished, a fatty acid having low molecular weight is generated therefrom, and the frictional force applied between the photoconductor and the cleaning blade is easily increased. As a result, toner components easily adhere together with the fatty acid in the form of a film on the photoconductor, leading to low-image resolution, abrasion of the photoconductor, and nonuniformity of image density.

Therefore, it is necessary to supply a large amount of metal soap so that the photoconductor surface is immediately covered with metal soap, even if such a fatty acid is generated. With increased demands for higher speed performance in image formation, the linear velocities of photoconductors become increasingly faster, and in accordance with this, the amount of metal soap to be supplied to a photoconductor should be increased.

In general, only supplying micronized metal soap particles onto a photoconductor does not cover the photoconductor surface with uniformity, and thus it is necessary to press-spread micronized metal soap particles in the form of a film by means of a blade.

For example, in Japanese Patent Application Laid-Open (JP-A) No. 2005-275166, a metal soap is applied onto a photoconductor with the size of metal soap particles being set to 1 μm or smaller, to thereby improve the cleanability. However, it has become known that when the linear velocity of the photoconductor used is fast, small metal soap particles to be supplied to the photoconductor pass through a blade with vibration from the driven photoconductor, easily causing regions where the metal soap is not formed in the form of a film.

Further, Japanese Patent Application Laid-Open (JP-A) No. 2008-224828 discloses that if metal soap particles to be supplied to a photoconductor are large in size, the metal soap reaches to the site immediately below a charging roller, metal soap particles electrostatically adhere onto the charging roller, the adhered metal soap is oxidized by the energy of AC charge to be fused and fixed to the charging roller. When the metal soap is fixed, it is fixed while involving toner components present on the photoconductor. Therefore, the resistivity of the charging roller at that part is increased to cause charging defects, resulting in the occurrence of black streaks. From the description above, it has been believed that metal soap particles to be supplied to a photoconductor has preferably small particle diameter.

Meanwhile, a protective agent block for use in an image forming apparatus is commonly produced by placing a melted metal soap into a molding dye, followed by cooling (see Japanese Patent Application Laid-Open (JP-A) No. 10-279998). Since crystal of the protective agent produced is isotropic and densely formed, and thus in order to increase the supply amount of metal soap, the pressure of a brush pressed against the protective agent block increases, and thus the durability of brush had been insufficient.

Also, metal soap particles scraped by a brush become an indefinitely shaped granular fine powder. The metal soap particles are blocked by a blade during low-linear velocity of the photoconductor, and then broken into pieces, further micronized and then applied onto the photoconductor. But when the amount of metal soap supplied in large amount, and the linear velocity of the photoconductor is made faster, relatively large metal soap particles before being applied onto the photoconductor are micronized to pass through a blade and reach a charging roller, then electrostatically adhere onto the charging roller, the adhered metal soap is oxidized by the energy of AC charge to be fused and fixed to the charging roller. When the metal soap is fixed, it is fixed while involving toner components present on the photoconductor. Therefore, the resistivity of the charging roller at that part is increased to cause charging defects, resulting in the occurrence of black streaks.

There is proposed a method for producing a protective agent block which causes no cracks and deficient portions, in which metal soap is placed in a dye which has been heated to a temperature lower than the melting point of the metal soap, 25° C. to 45° C., and compression-molded under reduced pressure (see Japanese Patent Application Laid-Open (JP-A) No. 2000-319224). According to this proposed method, energy for the temperature lower than the melting point of the metal sop is compensated by compression energy, and voids in the protective agent block are avoided by utilization of reduced pressure, and thus it is possible to produce a protective agent block which is substantially same as one produced by melting of a metal soap. However, in this protective agent block, when the amount of the metal soap is supplied in a large amount and the linear velocity of the photoconductor is made fast, relatively large metal soap particles before being applied onto the photoconductor are micronized to pass through a blade and reach a charging roller, then electrostatically adhere onto the charging roller, the adhered metal soap is oxidized by the energy of AC charge to be fused and fixed to the charging roller. When the metal soap is fixed, it is fixed while involving toner components present on the photoconductor. Therefore, the resistivity of the charging roller at that part is increased to cause charging defects, resulting in the occurrence of black streaks.

Further, as a metal soap, zinc stearate has been conventionally used, however, it has become known that use of a mixture of zinc stearate and zinc palmitate makes it possible to completely apply the mixture onto a photoconductor even in the case the linear velocity of the photoconductor is fast, but in the present situation, it is yet difficult to apply a mixture of zinc stearate and zinc palmitate onto a photoconductor, even when particles of the mixture are small or large.

BRIEF SUMMARY OF THE INVENTION

The present invention aims to provide a protective layer forming device which is capable of protecting the surface of a photoconductor even when the photoconductor has a high-linear velocity, and which is capable of forming a high-quality image without causing black streaks due to increased electric resistance of a charging roller used in the apparatus; an image forming apparatus and a process cartridge each using the protective layer forming device.

The present invention is based on the findings of the inventors of the present invention, and means for solving the problems in the related art are as follows:

<1> A protective layer forming device including:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

In the protective layer forming device according to <1>, appropriate controlling the particle diameter of the protective agent to be supplied onto a photoconductor makes it possible to provide a protective layer forming device capable of forming a high-quality image.

<2> The protective layer forming device according to <1>, wherein the metal soap is a mixture of zinc stearate and zinc palmitate.

In the protective layer forming device according to <2>, the use of a mixture of zinc stearate and zinc palmitate makes it possible to uniformly and completely apply the metal soap onto a photoconductor, even at a high linear velocity of the photoconductor, and thus it is possible to provide a protective layer coating device capable of forming a high-quality image.

<3> The protective layer forming device according to <1>, wherein the linear velocity of the photoconductor at the time of the protective agent in the form of a fine powder being supplied is 250 mm/sec or higher.

In the protective layer forming device according to <3>, it is possible to provide a protective layer coating device which having a high-quality image at a high image forming speed.

<4> The protective layer forming device according to <1>, further including a thin-layer forming unit configured to form the protective agent supplied onto the photoconductor into a thin layer.

In the protective layer forming device according to <4>, the protective agent supplied onto the photoconductor can be uniformly and completely applied thereon, and thus it is possible to provide a protective layer coating device capable of forming a high-quality image.

<5> The protective layer forming device according to <1>, wherein the protective agent in the form of a fine powder has a particle diameter of 20 μm to 200 μm and is formed of flat-shaped primary particles.

In the protective layer forming device according to <5>, since metal soap particles have a particle diameter of 20 μm to 200 μm are primary particles, the metal soap particles of 20 μm to 200 μm will not be small particles rapidly, and thus the metal soap particles remain in the vicinity of a blade to block passage of small metal soap particles and the metal soap can be uniformly and completely applied onto a photoconductor. Therefore, it is possible to provide a protective layer coating device capable of forming a high-quality image.

<6> The protective layer forming device according to <1>, wherein the protective agent block is formed so that the protective agent containing the metal soap is compressed 85% to 98% with respect to a specific gravity of the entire protective agent.

In the protective layer forming device according <6>, the protective agent supplied onto the photoconductor can be uniformly and completely applied thereon, and thus it is possible to provide a protective layer coating device capable of forming a high-quality image.

<7> An image forming apparatus including at least:

a photoconductor, a latent electrostatic image forming unit configured to form a latent electrostatic image on the photoconductor, a developing unit configured to develop the latent electrostatic image using a toner to form a visible image, a transfer unit configured to transfer the visible image onto a recording medium, a protective layer forming unit, and a fixing unit configured to fix the transferred image on the recording medium, wherein the protective layer forming unit includes:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

In the image forming apparatus according to <7>, it is possible to provide an image forming apparatus capable of forming a high-quality image with high reliability.

<8> A process cartridge adapted to be detachably mounted on a main body of an image forming apparatus, including at least:

a photoconductor, a developing unit configured to develop a latent electrostatic image using a toner to form a visible image on the photoconductor, and a protective layer forming unit, wherein the protective layer forming unit includes:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

In the process cartridge according to <8>, it is possible to provide a process cartridge capable of forming a high-quality image with high reliability.

The present invention can solve conventional problems, and can provide a protective layer forming device which is capable of protecting the surface of a photoconductor even when the photoconductor has a high-linear velocity, and which is capable of forming a high-quality image without causing black streaks due to increased electric resistance of a charging roller used in the apparatus; an image forming apparatus and a process cartridge each using the protective layer forming device.

DETAILED DESCRIPTION OF THE INVENTION

Protective Layer Forming Device

Figure 1:
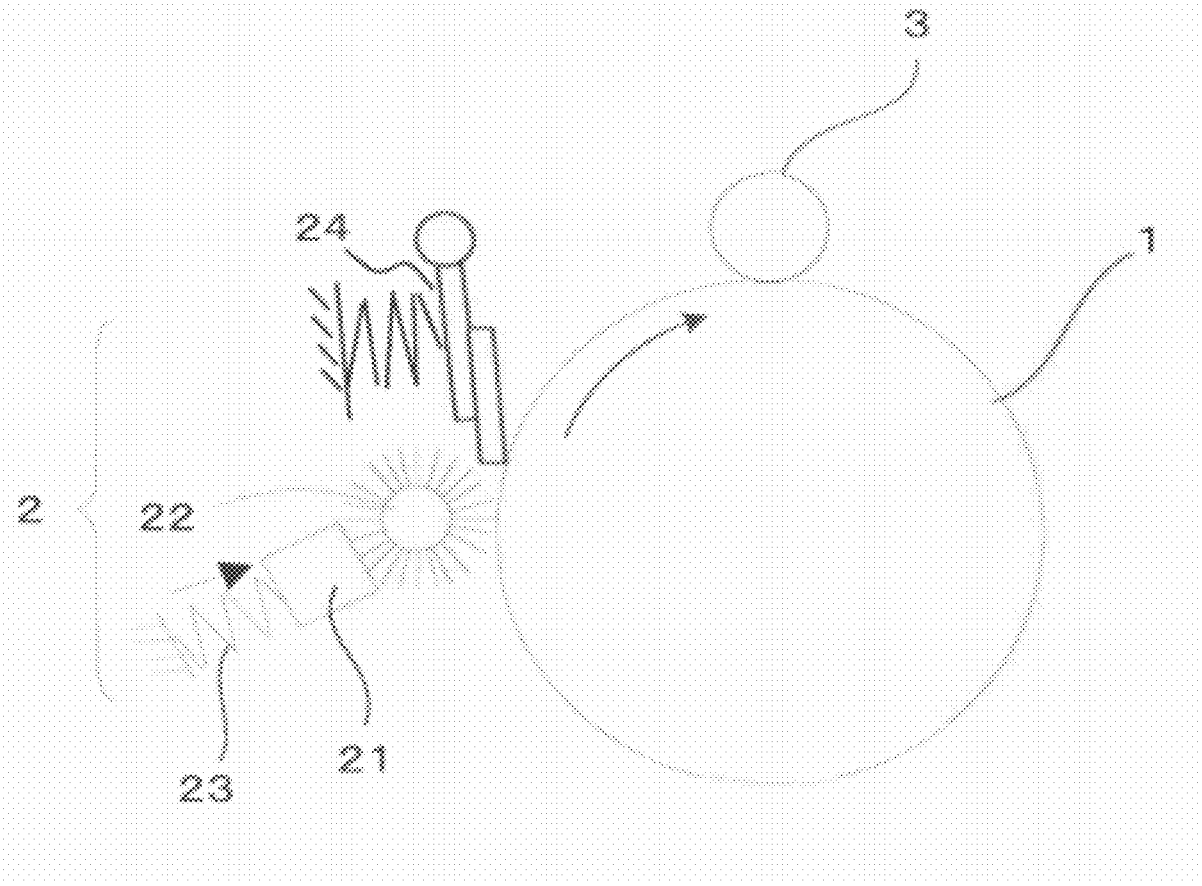
FIG. 1 is a schematic diagram showing one example of a protective layer forming device according to the present invention.

A protective layer forming device according to the present invention includes a protective agent block containing a metal soap, a pressing unit configured to press a protective agent supplying unit against the protective agent block, and a protective agent supplying unit configured to supply a protective agent onto a photoconductor, and further include other units as required.

In the present invention, the protective agent supplying unit is rotated while being pressed against the protective agent block, so that the protective agent block is micronized to make the protective agent in the form of a fine powder, and the protective agent in the form of a fine powder is supplied onto the photoconductor, thereby forming a protective layer on the photoconductor.

The protective agent in the form of a fine powder, supplied to the photoconductor, has a particle diameter of 200 μm or smaller, preferably 150 μm or smaller, more preferably 100 μm or smaller. Note that the protective agent must contain protective agent particles having a diameter of 20 μm or greater. When the particle diameter is greater than 200 μm, the amount of protective agent falling down from the photoconductor becomes large, the protective agent cannot be effectively used, the periphery of the protective layer forming device is contaminated, and the consumption speed of the protective agent block becomes fast, leading to an increase in the replacement frequency of the protective agent block. In addition, it may be difficult to uniformly and completely apply the protective agent onto the photoconductor because of a large gap between the protective layer forming device (a blade) and the protective agent lying in the vicinity of the blade.

Also, the protective agent in the form of a fine powder (hereinbelow, otherwise referred to as "finely powdered protective agent") supplied onto the photoconductor contains protective agent particles having a diameter of 20 μm to 200 μm in an amount of 1% by mass to 70% by mass, preferably in an amount of 3% by mass to 60% by mass, more preferably in an amount of 5% by mass to 50% by mass. When the amount of the protective agent particles having a diameter of 20 μm to 200 μm is less than 1% by mass, protective agent particles having a particle diameter smaller than 20 μm frequently slip through the blade, and it may be difficult to uniformly and completely apply the protective agent onto the photoconductor. When the amount of the protective agent particles having a diameter of 20 μm to 200 μm is more than 70% by mass, the protective agent may not be uniformly applied onto the photoconductor surface.

The particle diameter and the particle size distribution of the protective agent particles can be measured as follows. Specifically, a photoconductor, the protective agent block and the protective agent supplying unit are set in the protective layer forming device, the photoconductor and the protective layer forming device are operated for a certain time (preferably for 30 minutes to 5 hours), protective agent particles supplied onto the photoconductor are collected, and the particle size distribution of the collected particles by an optical microscope, an electron microscope or a Coulter counter. As the Coulter counter, a MULTISIZER III (manufactured by Beckman Coulter Co.) etc. can be used.

The method of controlling the size of protective agent particles to be supplied onto a photoconductor is not particularly limited, and differs depending on the production method of the protective agent block.

As the production method of the protective agent block, there are a melt molding method in which a metal soap is heated to a temperature equal to or higher than its melting point, the melt metal soap is poured into a molding die, and the melt metal soap is cooled to a temperature lower than its solidifying point to thereby produce a protective agent block; a compression molding method in which metal soap particles are compressed to thereby produce a protective agent block, etc.

The protective agent block produced by melt molding method is isotropic, and thus metal soap particles scraped by pressing a conventional brush against them have substantially same size. On that occasion, for the protective agent supplying unit (brush) pressed against the protective agent block, a plurality of different shaped furs or a plurality of furs having different physical properties are used. With use of different shaped furs or furs having different physical properties, metal soap large size particles and small size particles can be scraped at the same time and supplied to a photoconductor.

As the brush, furs which are different in shape or different in physical property may be transplanted in one brush, or two brushes may be pressed against the protective agent block so that metal soap particles having different particle diameters can be scraped.

When the protective agent block is produced by compression molding, metal soap particles before being compressed for molding are pushed and spread out to fuse to each other to be a protective agent block. At this point in time, individual metal soap particles pushed and spread out are built up while being fused to each other, and in a cross-section of the protective agent block, cleavage surfaces appear in every point of a cross-section of the protective agent block. Metal soap particles are not completely fused unless energy equivalent to its melting point or higher is applied thereto. Therefore, when the protective agent block is split, it easily splits along a surface of individual metal soap particles spread out. For this reason, when the size of metal soap particles spread out is greater than the diameter of brush furs, both small and large metal soap particles can be scraped by the brush. Naturally, just as in the protective agent block produced by melt molding, a plurality of different shaped furs or a plurality of furs having different physical properties may be used in a brush pressed against the protective agent block, or two different brushes may be used.

In use of metal soap particles produced by compression molding, large metal soap particles scraped by a brush are in the form of flat primary particles. Therefore, large metal soap particles are not immediately split into small particles, but they are fractured into smaller grains while remaining in front of the blade and moderately blocking small particles, and thus very favorably, the metal soap can be uniformly applied onto a photoconductor with reliability.

As a preferred production method of the protective agent block, it can be produced by compression molding, as described above. As the particle diameter of metal soap for use in production of the protective agent block of the present invention, it is preferred to produce it by mixing metals soaps of two or more different particle diameters. Specifically, it is preferable to use a mixture of particles having a diameter of 1 μm to 20 μm, preferably 2 μm to 18 μm, more preferably 3 μm to 15 μm and particles having a diameter of 20 μm to 200 μm, preferably 30 μm to 180 μm, more preferably 40 μm to 150 μm.

Even when a mixture of metal soap particles having such particle diameters is used, the metal soap particles are pushed and spread out. Therefore, mixed particles having different particle sizes are not scraped, as they are, by a brush, i.e., it does not depend on the shape and material of the brush, The degree of compression in the compression molding of the protective agent block is preferably set to 85% to 98% with respect to the true specific gravity of the entire protective agent. When the degree of compression is lower than 85% with respect to the true specific gravity of the entire protective agent, the mechanical strength of the protective agent block may decrease. In contrast, when it is higher than 98%, there is a need to increase the ability of the pressing machine, the metal soap is partially melted by application of compression pressure, the cleavage surfaces are greatly reduced, and when the metal soap particles are scraped by a brush, indefinitely shaped agglomerates are easily produced more than scale-like particles of the protective agent, and the protective agent is hardly formed on the photoconductor. Furthermore, protective agent particles pass through the blade and fly onto a charging roller to adhere thereto, resulting in easy occurrence of streaky abnormal images.

When the protective agent block is produced by compression molding, it is preferable to make the metal soap particles arranged in the same direction as much as possible, because it makes it possible for the cleavage surfaces to lie in the same direction. Therefore, after being placed into a molding die, the metal soap particles are preferably compressed while applying vibration, such as ultrasonic wave, thereto so that these particles are placed uniformly and arranged in a certain direction. Further, in the compression process, it is preferable to perform compression molding while applying pressure stepwise, because the amount of metal soap particles spilled out from the molding die is reduced.

The metal soap for use in the protective agent block is not particularly limited and may be suitably selected in accordance with the intended use. Examples thereof include compounds in which long-chain alkyl carboxylate salts having an anion ion in a hydrophobic region at its terminal end (e.g. laurate, myristic acid, palmitate, stearate, behenate, lignocerate, cerotinate, montanate, and melissicate) are bonded to alkali metal ions (e.g. sodium, potassium, etc.); alkali earth ions (e.g. magnesium, calcium, etc.); or metal ions (e.g. aluminum, zinc, etc.). Specific examples of such compounds are zinc stearate, calcium stearate, magnesium stearate, zinc laurate, calcium laurate, magnesium laurate, and zinc palmitate. These metal soaps may be used in combination. Among these, preferred are zinc stearate, zinc palmitate, and a mixture of zinc stearate with zinc palmitate, with particular preference being given to a mixture of zinc stearate with zinc palmitate.

Both the zinc stearate and the zinc palmitate are a fatty acid metal salt, and the fatty acid sites include a stearic acid having 18 carbon atoms and a palmitic acid having 16 carbon atoms. Accordingly, zinc stearate and zinc palmitate have a similar structure, highly miscible with each other and behave similarly to each other, and thus both of them can protect photoconductors, similarly.

The zinc palmitate has a melting point lower than the zinc stearate, and therefore when the zinc palmitate is contained in a certain amount or more, the resulting protective agent is easily extended by a blade, and so a photoconductor can be satisfactorily covered with the protective agent even when the linear velocity of the photoconductor is fast.

When the linear velocity of the photoconductor is fast, energy of charge, in particular, energy of an alternating current charger falling down onto the photoconductor is further intensified, and thus in order to enhance the effect of protecting the photoconductor by means of the protective agent, the protective agent should be made thick.

It is said that zinc stearate is stable in the state where two molecules thereof are attached to a photoconductor, not in the state where their molecules are randomly attached thereto. That is, even when zinc stearate is applied to a photoconductor surface, the effect of stability brought by the thickness of two-molecules is saturated. Then, by incorporating, into zinc stearate, zinc palmitate whose molecular length is slightly shorter than that of zinc stearate in a certain amount or more, the height of the molecular layer is not constant, and low-height parts coexist with high-height parts in the molecular layer. Then, next molecules get caught in high-height parts to form a molecular layer. Therefore, a protective agent layer which is thicker than the height of the two molecules can be formed, and as a result, the effect of protecting a photoconductor surface in enhanced. As a matter of course, when the amount of zinc palmitate becomes excessive, a two-molecule layer of zinc palmitate is easily formed and the protective agent is not formed thick. In addition, since zinc palmitate is smaller in size than zinc stearate, the effect of protecting a photoconductor surface is reduced as compared to the case of forming a layer using zinc stearate alone.

When a mixture of zinc stearate with zinc palmitate is used for a protective agent, individual powders thereof may be used in the form of a mixture, however, these individual powder particles have a certain size, and unfavorably, portions containing zinc stearate in a large amount and portions containing zinc palmitate in a large amount easily take place on the photoconductor. For this reason, it is preferable that zinc stearate and zinc palmitate be miscible with each other in one particle. As a method in which zinc stearate and zinc palmitate are miscible with each other in one particle, there are the following methods: a method in which zinc stearate and zinc palmitate are melted in each other, cooled, and pulverized to thereby produce a powder where these materials are miscible with each other; a method in which a stearic acid and a palmitic acid are mixed in a predetermined amount, and the mixture is used as a starting material to form it into a powder by dry process method, which is known as a method of producing a metal soap; or method of producing a powder where zinc stearate and zinc palmitate are miscible with each other, by wet process method. Particularly preferred is the method of using, as a starting material, a mixture in which a stearic acid and a palmitic acid are mixed in a predetermined amount, because the mixing ratio of the stearic acid to the palmitic acid is almost same as the mixing ratio of zinc stearate to zinc palmitate, and not only the zinc stearate and zinc palmitate are completely miscible with each other, but also extremely high reproducibility and high productivity can be obtained.

The ratio of zinc stearate to zinc palmitate in the protective agent block may be calculated by the incorporated amount of materials if the materials used are surely known, however, such materials surely contain impurities, and thus it is preferable to measure the ratio of zinc stearate to zinc palmitate in a produced protective agent block on a production lot basis. The ratio of zinc stearate to zinc palmitate in a protective agent block can be accurately determined according to the following manner. Specifically, a protective agent block is dissolved in a hydrochloric acid-methanol solution, the product is heated to 80° C. to methylate the stearic acid and palmitic acid, and the methylation product is analyzed by gas chromatography to thereby determine the ratio between stearic acid and palmitic acid.

The mass ratio of zinc stearate to zinc palmitate used in the protective agent block is preferably 75:25 to 40:60, more preferably 66:34 to 40:60, still more preferably 65:35 to 45:55. When the zinc stearate content is more than 75% by mass, and the linear velocity of a photoconductor is fast, the resulting protective agent is hardly applied onto the photoconductor. In contrast, when the zinc palmitate content is more than 60% by mass, the effect of protecting the photoconductor from an alternating current charger is reduced.

Into the protective agent for use in the present invention, metal soaps other than zinc stearate and zinc palmitate may be added. Note that metal soaps having a structure which greatly differs from the structures of zinc stearate and zinc palmitate are unfavorable because there is a potential for the metal soaps to disturb a protective layer formed, on a photoconductor, by zinc stearate and zinc palmitate. Therefore, metal soaps having a structure similar to the structures of zinc stearate and zinc palmitate (zinc soap of fatty acid having 13 to 20 carbon atoms) are preferable.

Also, in order to maintain the lubricity of a photoconductor, preferably talc and boron nitride which have self-lubricity are mixed in the protective agent. Among these, boron nitride is particularly preferable because it has a graphite structure, and therefore has high lubricity and is chemically stable. The amount of talc and/or boron nitride occupy the entire protective agent is preferably 1% by mass to 25% by mass, more preferably 2% by mass to 23% by mass, still more preferably 3% by mass to 21% by mass. When the amount of talc and/or boron nitride occupy the entire protective agent is less than 1% by mass, the self lubricity of talc and/or boron nitride is not exhibited, and so there is no point to incorporate them into a protective agent. When the amount of talc and/or boron nitride occupy the entire protective agent is more than 25% by mass, the talc and/or boron nitride accumulate thickly on a photoconductor, and undesirably this leads to a reduction in photosensitivity of the photoconductor.

In the protective agent, inorganic fine particles such as silica, alumina, ceria, zirconia, clay, calcium carbonate, and surface-hydrophobizing treatment fine particles thereof, organic fine particles such as polymethyl methacrylate fine particles, polystyrene fine particles, silicone resin fine particles, and α-olein-norbornene-copolymer resin fine particles, may be added. These particles themselves do not have an effect of protecting a photoconductor surface, but have an effect of leveling off a photoconductor-use protective agent attached on the photoconductor in excess amount. Among these particles, preferred is alumina, because even if attached onto a photoconductor, it does not reduce the photosensitivity of the photoconductor. When alumina is used, its particle diameter is preferably 0.05 μm to 2 μm, more preferably 0.10 μm to 1 μm, still more preferably 0.15 μm to 0.7 μm.

Besides, in order to enhance the affinity between the photoconductor-use protective agent and the photoconductor surface, an amphipathic organic compound, like surfactant, may be additionally used as a formulation additive for assisting the formation of a protective agent layer.

An amphipathic organic compound may greatly change the surface properties possessed by main materials, and thus the additive amount thereof relative to the total mass of the photoconductor-use protective agent is preferably 0.01% by mass to 3% by mass, more preferably 0.05% by mass to 2% by mass.

The protective agent block produced is used by being attached via an adhesive to a base material such as metal, alloy, and plastic.

The protective layer forming device of the present invention includes a protective agent block, a pressing unit configured to press a protective agent supplying unit against the protective agent block, and the protective agent supplying unit configured to supply a protective agent onto a photoconductor, includes a thin-layer forming unit, and further includes other units as required The protective layer forming device may serve as a cleaning unit, but in order to form a protective layer in an assured manner, it is preferable to remove residues mainly constituted by toner remaining on a photoconductor so as not to be mixed in the protective layer.

Here, FIG. 1 is a schematic diagram showing one example of the protective layer forming device of the present invention.

A protective layer forming device 2 which is arranged so as to face a photoconductor drum (photoconductor) 1, is mainly composed of a protective agent block 21, a protective agent supplying unit 22, a pressing unit 23, and a thin-layer forming unit 24.

The protective agent block 21 is brought into contact with the protective agent supplying unit 22, for example, in the form of a brush, by pressing force applied from the pressing unit 23. The protective agent supplying unit 22 rotates at a linear velocity different from that of the photoconductor 1 and at this time, protective agent supplying unit 22 supplies a protective agent held on its surface to a surface of the photoconductor 1.

The protective agent supplied to the photoconductor surface sometimes will not be a sufficient protective layer in the supply, and in order to form a further uniform protective layer, the protective agent supplied to the photoconductor surface is made into a thin layer by the thin-layer forming unit having a blade-shaped member, to be a protective layer.

A photoconductor with the protective layer formed on its surface, for example, is contacted and/or near contacted with a charging roller 3 to which a direct current voltage or an alternating current voltage superposed thereto is applied from a not illustrated power source, so that the photoconductor is charged by electric discharge in a microscopic space. On this occasion, a part of the protective layer is decomposed and/or oxidized under the influence of electric stress, and adhesion of discharge product in the air to the surface of the protective layer takes place to be a deteriorated product.

Figure 2:
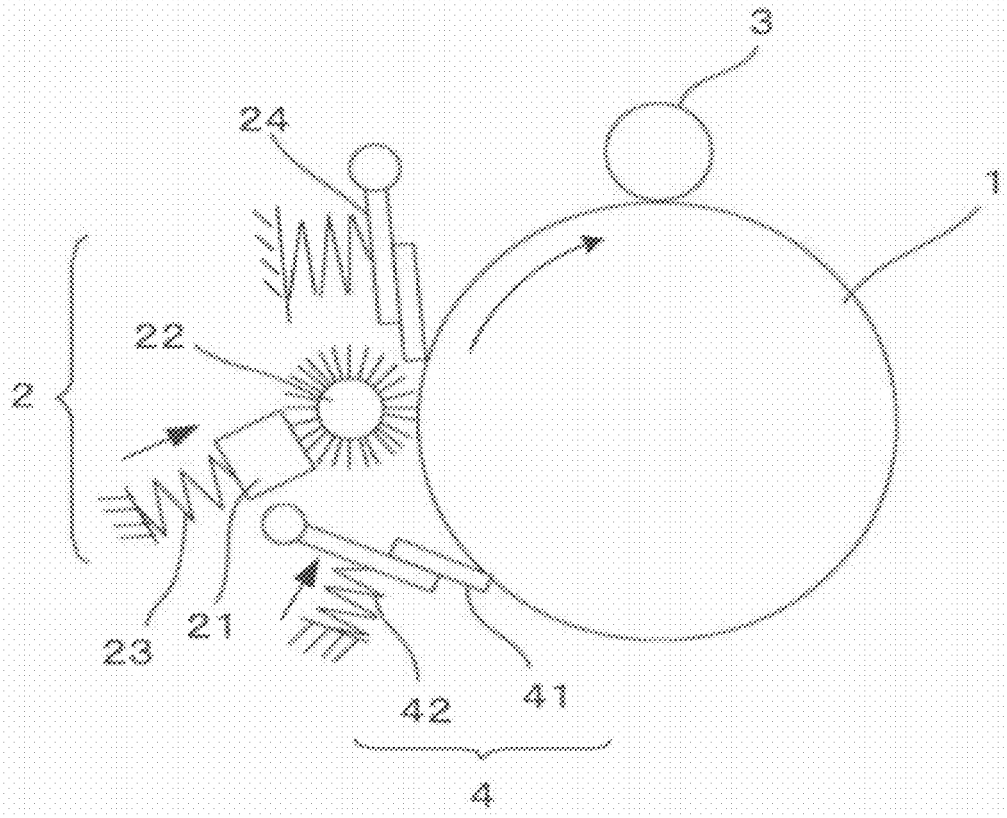
FIG. 2 is a schematic diagram showing another example of a protective layer forming device according to the present invention.

The deteriorated protective agent is removed together with toner components and the like remaining on the photoconductor, by a cleaning unit. The cleaning unit may serve as the above mentioned thin-layer forming unit 24, however, a function to remove residues on a photoconductor surface sometimes differs from a function to form a protective layer in terms of the scraped state brought by an appropriate member. Thus, it is preferred that these functions be separated and, as shown in FIG. 2, a cleaning unit 4 composed of a cleaning member 41, a cleaning-pressing mechanism 42 etc. be provided on the upstream side of the protective agent supplying unit Material of a blade for use in the thin-layer forming unit is not particularly limited and may be suitably selected from among those known as cleaning blade materials in the art according to the purpose. Examples thereof include urethane rubbers, hydrin rubbers, silicone rubbers, and fluorine rubbers. These may be used alone or in combination. The blade may be subjected to coating or dipping with a low-friction-coefficient material at its portion to be in contact with a photoconductor. Also, in order to adjust the hardness of the elastic body, an filler, such as an organic filler, an organic filler etc., may be dispersed therein.

The thin-layer forming unit may be arranged in both a counter direction and a trading direction with respect to the rotational direction of the photoconductor, however, the force of stretching the protective agent over the photoconductor is more intensified by mounting it in the counter direction. Accordingly, favorably, the protective agent can be stretched thereover in a short time.

The blade is secured on the photoconductor so that its leading edge is press contacted to the photoconductor surface, by an arbitrary method such as bonding and fusion bonding. The thickness of the blade is not unequivocally defined because it is determined in consideration of the force applied by pressing, however, it is preferably 0.5 mm to 5 mm, more preferably 1 mm to 3 mm.

Also, the length of a section protruding from the support of the cleaning blade so as to secure deflection, a so-called free length, is not unequivocally defined because it is determined in consideration of the force applied by pressing, however, it is preferably 1 mm to 15 mm, more preferably 2 mm to 10 mm.

As other structures of the blade, a coating layer of resin, rubber, elastomer, etc. is formed on a surface of an elastic metal blade such as a spring pressure plate, via a coupler, primer component or the like if necessary, by coating or dipping, followed by thermosetting as required, and further subjected to surface polishing, etc. if necessary.

The coating layer contains at least a binder resin and a filler, and further contains other components as required.

The binder resin is not particularly limited and may be suitably selected in accordance with the intended use. Examples thereof include fluororesins such as PFA, PTFE, FEP, and PVdF; and silicone elastomers such as fluorine rubbers, and methylphenyl silicone elastomers.

The thickness of the elastic metal blade is preferably 0.05 mm to 3 mm, more preferably 0.1 mm to 1 mm. The elastic metal blade may be subjected to bending in a direction substantially parallel to a spindle after being mounted, for the sake of preventing distortion thereof.

A pressing force of the thin-layer forming unit applied to the photoconductor is such a force that is enough for the protective agent to spread to be a protective agent, and the linear pressure is preferably 5 gf/cm to 80 gf/cm, more preferably 10 gf/cm to 60 gf/cm.

As the protective agent supplying unit, a brush-shaped member is preferably used. In this case, to reduce mechanical stress applied to the photoconductor surface, brush fibers preferably have flexibility. Materials of brush fibers having flexibility are not particularly limited and may be suitably selected in accordance with the intended use. Examples thereof include polyolefin resins (e.g. polyethylene, polypropylene, etc.); polyvinyl resins or polyvinylidene resins (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone, etc.); vinyl chloride-vinyl acetate copolymers; styrene-acrylic acid copolymers; styrene-butadiene resins; fluororesins (e.g., polytetrafluoroethylene, polyvinyl fluoride, polyvinylidene fluoride, polychlorotrifluoroethylene, etc.); polyesters; nylons; acryls; rayons; polyurethanes; polycarbonates; phenol resins; and amino resins (e.g., urea-formaldehyde resin, melamine resin, benzoguanamine resin, urea resin, polyamide resin, etc.

To adjust the degree of bending of the blade, diene rubber, styrene-butadiene rubber (SBR), ethylene propylene rubber, isoprene rubber, nitrile rubber, urethane rubber, silicone rubber, hydrin rubber, norbornene rubber or the like may be compounded, for example.

As a support for the protective agent supplying unit, there are fixed type ones and rotatable roll-shaped ones. Examples of roll-shaped supporting member are roll brushes in which for example, a tape formed of brush fibers transplanted on a pile fabric is wound spirally around a metal-cored bar to obtain a roll brush. The brush fibers have preferably a fiber diameter of about 10 μm to about 500 μm, a fiber length of 1 mm to 15 mm, and the fiber density of the brush is preferably 10,000/square inch to 300,000/square inch ($1.5\times10^7$ per square meter to $4.5\times10^8$ per square meter).

As the protective agent supplying unit, from the viewpoint of uniformity of supply and stability of supply, it is preferable to use the one having a high brush density. One fiber is preferably formed of from several fine filaments to several-hundreds of fine filaments. For example, as in 333 decitex=6.7 decitex×50 filaments (300 denier=6 denier×50 filaments, it is preferred that 50 fine filaments of 6.7 decitex (6 denier) be bundled into one fiber for fiber transplant.

For the purpose of stabilizing the surface shape of the brush and achieving environmental stability, a coating layer may be provided on a surface of the brush as required. As components constituting the coating layer, it is preferred to use components deformable according to the bending of the brush fibers. The components of the coating layer are not particularly limited, as long as they are materials capable of maintaining flexibility, and may be suitably selected in accordance with the intended use. Examples of the materials include polyolefin resins such as polyethylene, polypropylene, polyethylene chloride, and chlorosulfonated polyethylene; polyvinyl or polyvinylidene resins such as polystyrene, acryls (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinylketone; vinyl chloride-vinyl acetate copolymers, silicone resins including organosiloxane bonding and modified products thereof (e.g. modified products of alkyd resin, polyester resin, epoxy resin, polyurethane resin, or the like); fluororesins such as perfluoroalkyl ether, polyfluorovinyl, polyfluorovinylidene, and polychlorotrifluoroethylene; polyamides; polyesters; polyurethanes, polycarbonates; amino resins such as urea-formaldehyde resin; epoxy resins, and composite resins thereof.

(Image Forming Method and Image Forming Apparatus)

The image forming apparatus of the present invention includes at least a photoconductor, a latent electrostatic image forming unit, a developing unit, a transfer unit, a protective layer forming unit, and a fixing unit, preferably includes a cleaning unit, and further includes other units selected in accordance with the necessity, for example, a charge eliminating unit, a recycling unit, a controlling unit, and the like.

The image forming method used in the present invention includes at least a latent electrostatic image forming step, a developing step, a transferring step, a protective layer forming step, and a fixing step, preferably includes a cleaning step, and further includes other steps selected in accordance with the necessity, for example, a charge-eliminating step, a recycling step, a controlling step, and the like.

In the image forming apparatus of the present invention, a protective agent can be applied in uniform thickness onto a photoconductor even when the photoconductor rotates at any linear velocity, and therefore, high-quality images can be formed over a long period of time. However, when the linear velocity of the photoconductor is 250 mm/sec or higher, in particular, 450 mm/sec or higher, it is impossible to carry out formation of high-quality images over a long period of time, unless a protective agent for use in the present invention is used.

<Latent Electrostatic Image Forming Step and Latent Electrostatic Image Forming Unit>

The latent electrostatic image forming step is a step of forming a latent electrostatic image on a photoconductor.

-Photoconductor-

The photoconductor (otherwise, may be referred to as "latent electrostatic image-bearing member", "electrophotographic photoconductor") is not particularly limited as to the material, shape, structure, size and the like, and may be suitably selected from among those known in the art, however, as the shape, a drum shape is preferably exemplified. As the material, for example, inorganic photoconductors such as amorphous silicon, and selenium; and organic photoconductors such as polysilane, and phthalopolymethine are exemplified.

The photoconductor for use in the image forming apparatus of the present invention includes a conductive support, and at least a photosensitive layer on the conductive support, and further includes other layers, as necessary.

As the photosensitive layer, there are provided a single-layered photosensitive layer in which a charge generating agent and a charge transporting agent are mixed, a photosensitive layer of normal order layer constitution type in which a charge transporting layer is provided on a charge generating layer, and a photosensitive layer of inverse order layer constitution type in which a charge generating layer is provided on a charge transporting layer. In order to improve the mechanical strength, abrasion resistance, gas resistance, cleanability etc. of the photoconductor, an outermost surface layer may be provided on the photosensitive layer. Also, an undercoat layer may be provided between the photosensitive layer and the conductive support. In these layers, if necessary, a plasticizer, an antioxidant, a leveling agent etc. may also be added in an appropriate amount.

The conductive support is not particularly limited as long as it exhibits conductivity of volume resistance of $1.0\times10^{10}$ Ω·cm or lower, and may be suitably selected in accordance with the intended use. For example, the support may be prepared by applying a metal such as aluminum, nickel, chromium, nichrome, copper, gold, silver, or platinum or the like, or a metal oxide such as tin oxide or indium oxide or the like, for example, by vapor deposition or sputtering, onto film-form or cylindrical plastic or paper, or using a sheet of aluminum, aluminum alloy, nickel, or stainless steel or the like, and making it into a crude tube by extrusion or drawing or the like, and then surface-treating the tube by cutting, superfinishing, or grinding or the like.

The drum-shaped support preferably has a diameter of 20 mm to 150 mm, more preferably 24 mm to 100 mm, still more preferably 28 mm to 70 mm. When the diameter of the drum-shaped support is smaller than 20 mm, it becomes difficult to arrange each individual unit for charging, exposing, developing, transferring, and cleaning around the photoconductor drum. When it is greater than 150 mm, the image forming apparatus itself may be large in size. In particular, in the case of a tandem type image forming apparatus, there is a need to provide a plurality of photoconductors, and thus the diameter is preferably 70 mm or smaller, more preferably 60 mm or smaller.

Also, the endless nickel belt and endless stainless belt disclosed in Japanese Patent Application Laid-Open (JP-A) No. 52-36016 (Published) may also be used as the support.

The undercoat layer of the photoconductor may be a single layer or may be formed of a plurality of layers. For example, there may be exemplified: (1) a layer primarily containing a resin, (2) a layer primarily containing a white pigment and a resin, and (3) a metal-oxide film in which a surface of a conductive support is chemically or electrochemically oxidized. Among these, preferred is a layer primarily containing a white pigment and a resin. Examples of the white pigment include metal oxides such as titanium oxide, aluminum oxide, zirconium oxide, and zinc oxide. Among these, particularly preferred is a titanium oxide which is superior in ability of preventing injection of electric charge from the conductive support.

Examples of the resin include thermoplastic resins such as polyamide, polyvinyl alcohol, casein, and methyl cellulose; and thermosetting resins such as acryl resin, phenol resin, melamine resin, alkyd resin, unsaturated polyester resin, and epoxy resin. These may be used alone or in combination.

The thickness of the undercoat layer is not particularly limited and may be suitably adjusted in accordance with the intended use. It is preferably 0.1 μm to 10 μm, more preferably 1 μm to 5 μm.

Examples of the charge generating material in the photosensitive layer include azo pigments such as monoazo pigment, bisazo pigment, trisazo pigment, and tetrakis-azo pigment; organic pigments or dyes such as triarylmethane dye, thiazine dye, oxazine dye, xanthene dye, cyanine dye, styryl dye, pyrylium dye, quinacridone pigment, indigo pigment, perylene pigment, polycyclic quinone pigment, bisbenzimidazole pigment, indanthrone pigment, squarylium dye, and phthalocyanine pigment; and inorganic materials such as selenium, selenium-tellurium, cadmium sulfide, zinc oxide, titanium oxide, and amorphous silicon. These may be used alone or in combination.

Examples of the charge transporting agent in the photosensitive layer include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. These may be used alone or in combination.

A binder resin for use in forming the photosensitive layer is electrically insulative, and known materials such as thermoplastic resin, thermosetting resin, photocurable resin and photoconductive resin etc. may be used. Specific examples of the binder resin include thermoplastic resins such as polyvinyl chloride, polyvinylidene chloride, vinyl chloride-vinyl acetate copolymers, polyvinyl butyral, polyvinyl acetal, polyester, phenoxy resin, (meth)acrylic resin, polystyrene, polycarbonate, polyacrylate, polysulfonate, polyether sulfonate, and ABS resin; thermosetting resins such as phenol resin, epoxy resin, urethane resin, melamine resin, isocyanate resin, alkyd resin, silicone resin, and thermosetting acrylic resin; polyvinyl carbazole, polyvinylanthracene, and polyvinyl pyrene. These may be used alone or in combination.

Examples of the antioxidant include phenol compounds, paraphenylenediamines, organic sulfur-containing compounds, and organic phosphorus-containing compounds.

Examples of the phenol compounds include 2,6-di-t-butyl-p-cresol, butylated hydroxyanisole, 2,6-di-t-butyl-4-ethylphenol and stearyl-β-(3,5-di-t-butyl-4-hydroxyphenyl) propionate; 2,2'-methylene-bis-(4-methyl-6-t-butylphenol), 2, 2'-methylene-bis-(4-ethyl-6-t-buty 4,4'-thiobis-(3-methyl-6-t-butylphenol) and 4,4'-butylidenebis-(3-methyl-6-t-butylphenol); 1,1,3-tris-(2-methyl-4-hydroxy-5-t-butylphenyl) butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl)propionate]methane, his [3,3'-bis (4'-hydroxy-3'-t-butylphenyl)butyric acid]glycol ester and tocophenol compounds Examples of the paraphenylenediamines include N-phenyl-N' isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone.

Examples of the organic sulfur-containing compounds such as dilauryl-3,3'-thiodipropionate, distearyl-3,3'-thiodipropionate and ditetradecyl-3,3'-thiodipropionate.

Examples of the organic phosphorus-containing compounds include triphenylphosphine, tri(nonylphenyl) phosphine, tri(dinonylphenyl) phosphine, tricresylphosphine and tri(2,4-dibutylphenoxy) phosphine.

These compounds are known as antioxidants such as rubbers, plastics, and fatty oils, and commercial products thereof are easily available.

The additive amount of the antioxidant is preferably 0.01% by mass to 10% by mass relative to the total mass of the layer to which the antioxidant is added.

As the plasticizers, commonly used resin known as a plasticizer, such as dibutylphthalate and dioctylphthalate, can be directly used. The use amount of the plasticizer is preferably 30 parts by mass or less per 100 parts by mass of the binder resin.

In the photosensitive layer, a leveling agent may also be added. As the leveling agent, for example, the following are used: silicone oils such as dimethyl silicone oil, methylphenyl silicone oil; polymers having a perfluoroalkyl group at their side chains, or oligomers.

The use amount of the leveling agent is preferably 1 part by mass or less per 100 parts by mass of the binder resin.

The outermost surface layer of the photoconductor is provided for improving the mechanical strength, abrasion resistance, gas resistance, cleanability etc. of the photoconductor. As the outermost surface layer, polymer having a mechanical strength higher than the photosensitive layer, and a compound in which an inorganic filler is dispersed in polymer are preferred. The resin for use in the outermost surface layer may be a thermoplastic resin or a thermocurable resin. The thermocurable resin is particularly preferable because it has strong mechanical strength and extremely high ability of reducing abrasion caused by friction with a cleaning blade. There is no problem that the surface layer does not have charge transportability provided that it has thin thickness. However, when a surface layer having no charge transportability is formed thick, it easily cause degradation of photosensitivity of a photoconductor, an increase in potential after exposure and an increase in residual potential. Therefore, it is preferred to incorporate the above-mentioned charge transporting material into the surface layer or to use a material having charge transportability as the polymer for use in the surface layer.

As the photosensitive layer and the outermost surface layer are greatly different from each other in their mechanical strength, the outermost surface layer is abraded by friction against a cleaning blade, and naturally peeled off, the photoconductor is soon abraded. Therefore, when an outermost surface layer is provided, it is important for the outermost surface layer to have an adequate thickness. The thickness is preferably 0.1 μm to 12 μm, more preferably 1 μm to 10 μm, still more preferably 2 μm to 8 μm. When the thickness is less than 0.1 μm, the outermost surface layer tends to be partially removed because of its thin thickness, by friction with a cleaning blade, abrasion of the photosensitive layer proceeds from the removed portion. When it is more than 12 μm, degradation of photosensitivity, an increase in potential after exposure, and an increase in residual potential easily occur. Particularly when a polymer having an electric charge transportability is used, the cost of polymer having a charge transportability may expensive.

As a resin for use in the outermost surface layer, a resin which is transparent to wiring light used in the image formation and is superior in insulating property, mechanical strength and adhesiveness. Examples of such a resin include ABS resins, ACS resins, olefin-vinyl monomer copolymers, chlorinated polyether, acrylic resins, phenol resins, polyamide, polyamideimide, polyacrylate, polyallyl sulfone, polybutylene, polybutylene terephthalate, polycarbonate, polyether sulfone, polyethylene, polyethylene terephthalate, polyimide, polymethyl benzene, polypropylene, polyphenylene oxide, polysulfone, polystyrene, AS resins, butadiene-styrene copolymers, polyurethane, polyvinyl chloride, polyvinylidene chloride, and epoxy resins. These polymers may be thermoplastic resins, however, in order to increase the mechanical strength, they may be crosslinked with a crosslinker having a polyfunctional acryloyl group, carboxyl group, hydroxyl group, amino group or the like to be thermocurable resins. With this, it is possible to increase the mechanical strength of the outermost surface layer and to greatly reduce abrasion caused by friction with a cleaning blade.

The outermost surface layer preferably has charge transportability. To allow the outermost surface layer to have charge transportability, the following methods are conceivable: a method of using the polymer for use in the outermost surface layer and the above-noted charge transporting material in the form of a mixture, and a method of using a polymer having charge transportability in the outermost surface layer. The latter method is preferred in terms that it is possible to obtain a photoconductor having high-photosensitivity and causing less increase in potential and less increase in residual potential after being exposed.

As a group having charge transportability in the polymer having charge transportability, compounds having a group represented by the following Structural Formula (1) are preferably exemplified.

Structural Formula (1)

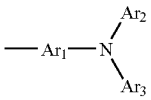

In Structural Formula (1), $Ar_1$ represents an allylene group that may have a substituent; and $Ar_2$, and $Ar_3$ may be identical to or different from each other, and each represent an aryl group that may have a substituent.

The group having charge transportability is preferably added to side chains of a polymer having high mechanical strength, such as polycarbonate resin and acrylic resin, and it is particularly preferable to use an acrylic resin which can readily produce a monomer and is superior in coatability and curability.

The acrylic resin having charge transportability may be polymerized with the unsaturated carboxylic acid having a group represented by Structural Formula (1), thereby making it possible to form a surface layer which has high mechanical strength and high charge transportability and is superior in transparency. By mixing a polyfunctional unsaturated carboxylic acid, preferably a trifunctional or more unsaturated carboxylic acid with a monofunctional unsaturated carboxylic acid having a group represented by Structural Formula (1), the acrylic acid forms a crosslinking structure to be a thermocurable polymer, and the surface layer will have extremely high mechanical strength. To the polyfunctional unsaturated carboxylic acid, a group represented by Structural Formula (1) may be added, however, the production cost of the monomer is expensive. For this reason, it is preferable to use a photocurable polyfunctional monomer for the polyfunctional unsaturated carboxylic acid, without adding a group represented by Structural Formula (1).

As the monofunctional unsaturated carboxylic acid having a group represented by Structural Formula (1), the following Structural Formula (2) and Structural Formula (3) are exemplified.

Structure Formula (2)

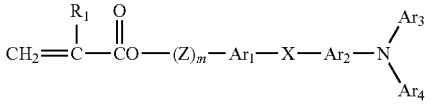

Structure Formula (3)

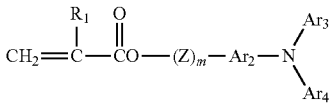

In Structural Formulas (2) and (3), $R_1$ represents a hydrogen atom, a halogen atom, an alkyl group that may have a substituent, an aralkyl group that may have a substituent, an aryl group that may have a substituent, a cyano group, a nitro group, an alkoxy group that may have a substituent, —$COOR_7$ (where $R_7$ represents a hydrogen atom, an alkyl group that may have a substituent, an aralkyl group that may have a substituent, or an aryl group that may have a substituent), a halogenated carbonyl group, or $CONR_8R_9$ (where $R_8$ and $R_9$ may be identical to or different from each other, and each represent a hydrogen atom, a halogen atom, an alkyl group that may have a substituent, an aralkyl group that may have a substituent or an aryl group that may have a substituent).

In Structural Formulas (2) and (3), $Ar_1$ and $Ar_2$ may be identical to or different from each other, and each represent an allylene group that may have a substituent that may have a substituent.

In Structural Formulas (2) and (3), $Ar_3$ and $Ar_4$ may be identical to or different from each other, and each represent an aryl group that may have a substituent.

In Structural Formulas (2) and (3), X represents a single bond, an alkylene group that may have a substituent, a cycloalkylene group that may have a substituent, or an alkylene ether group that may have a substituent, an oxygen atom, a sulfur atom, or a vinylene group.

In Structural Formulas (2) and (3), Z represents an alkylene group that may have a substituent, an alkylene ether divalent group that may have a substituent, or an alkylene oxycarbonyl divalent group that may have a substituent; m and n each represent an integer of 0 to 3.

In Structural Formulas (2) and (3), in the substituent of $R_1$, as the alkyl group, for example, methyl group, ethyl group, propyl group, butyl group and the like are exemplified; as the aryl group, for example, phenyl group and naphthyl group are exemplified; as the aralkyl group, for example, benzyl group, phenetyl group and naphthyl group are exemplified; as the alkoxy group, for example, methoxy group, ethoxy group and propoxy group are exemplified; each of these groups may be substituted with a halogen atom, a nitro group, a cyano group; an alkyl group (methyl group, ethyl group, etc.); an alkoxy group (methoxy group, ethoxy group, etc.); an aryloxy group (phenoxy group, etc.); an aryl group (phenyl group, naphthyl group, etc.); an aralkyl group (benzyl group, phenethyl group, etc.) or the like. Among these substituents of $R_1$, particularly preferred are a hydrogen atom and a methyl group.

Examples of the aryl group of $Ar_3$ and $Ar_4$ are condensed polycyclic hydrocarbon group, non-condensed cyclic hydrocarbon group, and heterocyclic group.

The condensed polycyclic hydrocarbon group is preferably one having 18 or less to form a ring. Examples thereof include pentanyl group, indenyl group, naphthyl group, azulenyl group, heptaprenyl group, biphenylenyl group, as-indacenyl group, s-indacenyl group, fluorenyl group, acenaphthylenyl group, pleiadenyl group, acenaphthenyl group, phenalenyl group, phenathryl group, antholyl group, fluorandenyl group, acephenanthrylenyl group, aceanthrylenyl group, triphenylenyl group, pyrenyl group, chrysene, and naphthacenyl group.

Examples of the non-condensed hydrocarbon group include a monovalent group of monocyclic hydrocarbon compounds such as benzene, diphenyl ether, polyethylenediphenyl ether, diphenylthioether and diphenylsulphone, a monovalent group of non-fused polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or a monovalent group of cyclic hydrocarbon compounds such as 9,9-diphenylfluorene.

Examples of the heterocyclic group include a monovalent group of carbazole, dibenzofuran, dibenzothiophene, oxadiazole, and thiadiazole.

The amount of the polyfunctional unsaturated carboxylic acid relative to the total mass of the outermost surface layer is preferably 5% by mass to 75% by mass, more preferably 10% by mass to 70% by mass, still more preferably 20% by mass to 60% by mass. When the amount is less than 5% by mass, the mechanical strength of the outermost surface layer is insufficient, and when it is more than 75% by mass, cracks easily occur when a strong force is applied to the outermost surface layer, and degradation of photosensitivity may also easily occur.

When an acrylic resin is used in the outermost surface layer, the unsaturated carboxylic acid is applied onto a photoconductor, and the photoconductor is exposed to electron beam radiation, or active ray such as ultraviolet ray to cause radical polymerization, thereby a surface layer can be formed. When the radical polymerization is performed using active ray, a solution is used in which a photopolymerization initiator is dissolved in an unsaturated carboxylic acid. As the photopolymerization initiator, usually, materials for use in photocurable dyes can be used.

In order to enhance the mechanical strength of the outermost surface layer, the outermost surface layer preferably contains metal fine particles, metal oxide fine particles, other fine particles, etc. Examples of the metal oxides include titanium oxide, aluminum oxide, tin oxide, potassium oxide, TiO, TiN, zinc oxide, indium oxide, antimony oxide. As other fine particles, for the purpose of improving abrasion resistance, there may be exemplified fluororesins such as polytetrafluoroethylene, silicone resin; and compounds in which inorganic material are dispersed in these resins.

Next, a latent electrostatic image can be formed by, for example, uniformly charging a surface of the photoconductor, and exposing the photoconductor surface imagewise, and this can be achieved by the latent electrostatic image forming unit. The latent electrostatic image forming unit is equipped with at least a charger for uniformly charging a surface of the photoconductor and an exposing device for exposing the photoconductor surface imagewise.

The charging can be performed by, for example, applying a voltage to a surface of the photoconductor using the charger.

The charger is not particularly limited and may be suitably selected in accordance with the intended use. Examples of the charger include contact type chargers known in the art, such as a charger equipped with a conductive or semi-conductive roller, brush, film and/or rubber blade; and non-contact type chargers utilizing corona discharge such as corotron and scorotron.

The charger preferably has a voltage applying unit which applies a voltage having an alternating component.

The exposure can be performed by exposing a surface of the photoconductor imagewise, by using the exposing device.

The exposing device is not particularly limited as long as it can expose the photoconductor surface that has been charged by the charger in the same way as the image to be formed, and may be suitably selected in accordance with the intended use. As the exposing device, a variety of exposing devices such as copy optical system, rod lens array system, laser optical system, and liquid crystal shutter optical system may be exemplified.

In the present invention, a backlight system may be employed by which the photoconductor is exposed imagewise from its rear surface.

<Developing Step and Developing Unit>

The developing step is a step of developing the latent electrostatic image using a toner and/or developer to form a visible image.

Formation of the visible image can be performed by, for example, developing the latent electrostatic image using the toner and/or the developer, by means of the developing unit.

The developing unit is not particularly limited as long as it can develop an image using the toner and/or the developer, and may be suitably selected from among those known in the art. Preferred examples include those which have at least an image-developing device to house the toner and/or the developer and which may supply the toner and/or the developer in contact or non-contact with the latent electrostatic image.

-Toner-

The toner preferably has an average circularity, which is an average value of a circularity SR represented by the following Equation 1, of 0.93 to 1.00, more preferably 0.95 to 0.99.

The average circularity is an index of degree of concavo-convex degree of a toner particle. When a toner has a completely spherical shape, the toner has an average circularity of 1.00. The more complicate the surface configuration of a toner particle becomes, the smaller the value of average circularity is.

(Circularity)=(circumferential length of circle equal to projected area of particle)/(circumferential length of projected image of particle) Equation 1

In the range of average circularity of 0.93 to 1.00, surfaces of toner particles are smooth, the contact area between toner particles and the contact area of toner particles with a photoconductor are small, and thus the toner is superior in transferability. In addition, since the toner particles do not have corners, the agitation talc of the developer in a developing device is small and the drive of agitation is stabilized, abnormal images will not occur. Also, square-cornered toner particles are not present in a toner forming dots, and thus when the toner is press-contacted with a recording medium in transfer process, the pressure is uniformly applied to the entire of toner (toner particles) forming dots. Therefore, transfer drop-out hardly occurs. Because the toner particles have no square-corner, the toner particles themselves have small frictional force and thus do not scratch and do not abrade surfaces of photoconductors.

The circularity SR can be measured by, for example, a flow type particle image analyzer, FPIA-1000 (manufactured by Sysmex Corporation) in the following manner.

Specifically, into a container from which impurity solids have been preliminarily removed, 100 ml to 150 ml of water is poured, 0.1 ml to 0.5 ml of a surfactant (preferably, alkylbenzene sulfonate) as a dispersant is added to the water, and about 0.1 g to about 0.5 g of a measurement sample was further added to the water to obtain an aqueous dispersion liquid. The aqueous dispersion, in which the measurement sample is suspended, is then subjected to a dispersion treatment by a supersonic wave dispersing machine for about 1 minute to about 3 minutes. The concentration of the dispersion liquid is adjusted to 3,000/μl to 10,000/μl.

A mass average particle diameter (D4) of the toner is preferably 3 μm to 10 μm, more preferably 4 μm to 8 μm. Within the mass average particle diameter (D4) falling in this range, the toner has toner particles which are sufficiently small to microscopic dots in a latent image, and thus the toner is superior in dot reproducibility. When the mass average particle diameter (D4) is smaller than 3 μm, phenomena of degradation of transfer efficiency and degradation of blade-cleanability easily occur. When the mass average particle diameter (D4) is greater than 10 μm, it may become difficult to reduce blur of characters and lines.

At the same time, a ratio (D4/D1) of the weight-average particle diameter (D4) to a number-average particle diameter (D1) is preferred to be in a range of 1.00 to 1.40, more preferably in a range of 1.00 to 1.30. As the ratio (D4/D1) is closer to 1.00, a particle-size distribution is getting sharpened. When the toner has a ratio (D4/D1) ranging from 1.00 to 1.40, selective phenomena caused by toner diameters do not occur, and therefore it is superior in image stability. In addition, since the particle size distribution of the toner is sharp, the frictional charge quantity distribution also becomes sharp. As a result, it is possible to suppress the occurrence of fogging. With uniformity of toner particle diameter, the toner has excellence in the dot reproducibility because an image can be developed so that the toner particles are densely arrayed in an orderly manner.

Here, the mass average particle diameter (D4) and the particle size distribution of the toner are measured by, for example, Coulter counter method. As a particle size distribution-measuring device of toner particles by the Coulter counter method, COULTER COUNTER TA-II and COULTER COUNTER MULTISIZER II (both manufactured by Beckman Coulter Co.) are exemplified.

Firstly, in 100 ml to 150 ml of an aqueous electrolyte, 0.1 ml to 5 ml of a surfactant as a dispersant (preferably, alkylbenzene sulfonate) is added. As the aqueous electrolyte, an approximately 1%-NaCl aqueous solution is prepared using primary sodium chloride, and ISOTON-II (available from Beckman Coulter Co.) can be used. Further, 2 mg to 20 mg of a measurement sample is added to the electrolyte. The electrolyte, in which the measurement sample is suspended, is then subjected to a dispersion treatment by a supersonic wave for 1 minute to 3 minutes. The volume and the numbers of toner particles or a toner can be measured by the above measuring device, with use of an aperture of 100 μm, followed by calculation of a volume distribution and a number distribution. From the resulting distributions, a mass average particle diameter (D4) and a number average particle diameter (D1) can be determined.

The following 13 channels are used to measure particles having diameters of 2.00 μm or greater and smaller than 40.30 μm: a channel of 2.00 μm or greater and smaller than 2.52 μm, a channel of 2.52 μm or greater and smaller than 3.17 μm; a channel of 3.17 μm or greater and smaller than 4.00 μm; a channel of 4.00 μm or greater and smaller than 5.04 μm; a channel of 5.04 μm or greater and smaller than 6.35 μm; a channel of 6.35 μm or greater and smaller than 8.00 μm; a channel of 8.00 μm or greater and smaller than 10.08 μm; a channel of 10.08 μm or greater and smaller than 12.70 μm; a channel of 12.70 μm or greater and smaller than 16.00 μm; a channel of 16.00 μm or greater and smaller than 20.20 μm; a channel of 20.20 μm or greater and smaller than 25.40 μm; a channel of 25.40 μm or greater and smaller than 32.00 μm; and a channel of 32.00 μm or greater and smaller than 40.30 μm.

Such a substantially spherically shaped toner can be produced by crosslinking and/or elongation reaction, in an aqueous medium, a toner composition containing a polyester prepolymer having a functional group which includes a nitrogen atom, polyester, colorant and releasing agent, in the presence of resin fine particles. A toner produced by the reaction makes it possible to reduce the occurrence of hot-offset by curing the toner surface, thereby making it possible to prevent toner particles from being smear on a fixing device to appear in an output image.

As the prepolymer containing a modified polyester resin, a polyester prepolymer (A) having an isocyanate group is exemplified. As a compound to be elongated or crosslinked with the prepolymer, amines (B) are exemplified.

Examples of the polyester prepolymer having an isocyanate group (A) include compounds obtained by reacting polyester which is a polycondensation product between polyol (1) and polycarboxylic acid (2) and which has an active hydrogen group, with a polyisocyanate (3). Examples of the active hydrogen group possessed by the polyester include hydroxyl groups (alcoholic hydroxyl group and phenolic hydroxyl group), amino group, carboxyl group, and mercapto group, with particular preference being given to alcoholic hydroxyl group.

Examples of the polyol (1) include diol (1-1), and trivalent or higher polyol (1-2). Preferred is a single use of (1-1), or a mixture of (1-1) with a small amount of (1-2).

Examples of the diol (1-1) include alkylene glycol (ethylene glycol, 1,2-propylene glycol, 1,3-propylene glycol, 1,4-butanediol, 1,6-hexanediol, etc.); alkylene ether glycol (diethylene glycol, triethylene glycol, dipropylene glycol, polyethylene glycol, polypropylene glycol, polytetramethylene ether glycol, etc.); alicyclic diol (1,4-cyclohexanedimethanol, hydrogenated bisphenol A, etc.); bisphenols (bisphenol A, bisphenol F, bisphenol S, etc.); alkylene oxides of the above alicyclic diols (ethylene oxide, propylene oxide, butylene oxide, etc.) adducts; and alkylene oxides of the above bisphenols (ethylene oxide, propylene oxide, butylene oxide, etc.) adducts. Among these, preferred are alkylene glycol having 2 to 12 carbon atoms, and alkylene oxide adducts of bisphenols, and particularly preferred are alkylene oxide adducts of bisphenols, and combined use of alkylene glycol having 2 to 12 carbon atoms therewith.

Examples of the trivalent or higher polyol (1-2) include trivalent to octavalent or higher polyhydric aliphatic alcohols (glycerine, trimethylolethane, trimethylolpropane, pentaerythritol, sorbitol, etc.); trivalent or higher phenols (trisphenol PA, phenol novolac, cresol novolac, etc.); and alkylene oxides of the above trivalent or higher polyphenols.

Examples of the polycarboxylic acid (2) include dicarboxylic acid (2-1) and trivalent or higher polycarboxylic acid (2-2), with preference being given to single use of (2-1), and a mixture of (2-1) with a small amount of (2-2).

Examples of the dicarboxylic acid (2-1) include alkylene dicarboxylic acid (succinic acid, adipic acid, sebacic acid, etc.); alkenylene dicarboxylic acid (maleic acid, fumaric acid, etc.); and aromatic dicarboxylic acid (phthalic acid, isophthalic acid, terephthalic acid, naphthalene dicarboxylic acid, etc.). Among these, particularly preferred are alkenylene dicarboxylic acid having 4 to 20 carbon atoms, and aromatic dicarboxylic acid having 8 to 20 carbon atoms.

Examples of the trivalent or higher polycarboxylic acid (2-2) include aromatic polycarboxylic acid having 9 to 20 carbon atoms. Note that as the polycarboxylic acid (2), an acid anhydride of the above mentioned or low-molecular alkyl ester (methyl ester, ethyl ester, isopropyl ester, etc.) may be used to react with the polyol (1).

The mixing ratio of the polyol (1) to the polycarboxylic acid (2), as an equivalent ratio [OH]/[COOH] of hydroxyl group [OH] content to carboxyl group [COOH] content is preferably 2/1 to 1/1, more preferably 1.5/1 to 1/1, and still more preferably 1.3/1 to 1.02/1.

Examples of the polyisocyanate (3) include aliphatic polyisocyanates (tetramethylene diisocyanate, hexamethylene diisocyanate, 2,6-diisocyanate methylcaproate, etc.); alicyclic polyisocyanates (isophorone diisocyanate, cyclohexyl methane diisocyanate, etc.); aromatic diisocyanates (tolylenediisocyanate, diphenylmethane diisocyanate, etc.); aroma-aliphatic diisocyanate ($\alpha,\alpha,\alpha',\alpha'$-tetramethylxylene diisocyanate, etc.); and isocyanurates; the polyisocyanates blocked with a phenol derivative, oxime, caprolactam or the like. These may be used alone or in combination.

The mixing ratio of the polyisocyanate (3), as an equivalent ratio [NCO]/[OH] of isocyanate group [NCO] content in the polyisocyanate (3) to hydroxyl group [OH] content in the hydroxyl group-containing polyester, is preferably 5/1 to 1/1, more preferably 4/1 to 1.2/1, and still more preferably 2.5/1 to 1.5/1. When the mixing ratio [NCO]/[OH] is more than 5, the low-temperature fixability may degrade. When the molar ratio of [NCO] is less than 1, the urea content in the modified polyester is lowered to cause degradation of hot-offset resistance.

The amount of components constituting the polyisocyanate (3) in the prepolymer (A) having an isocyanate group at its terminal end is preferably 0.5% by mass to 40% by mass, more preferably 1% by mass to 30% by mass, still more preferably 2% by mass to 20% by mass. When the amount is less than 0.5% by mass, the hot-offset resistance degrades, and it is disadvantageous in satisfying both heat resistant storage stability and low-temperature fixability at the same time. When it is more than 40% by mass, the low-temperature fixability may degrade.

The number of isocyanate groups contained per molecule in the prepolymer (A) having an isocyanate group is preferably one or more on average, more preferably 1.5 to 3 on average, still more preferably 1.8 to 2.5 on average. When the number of isocyanate groups is less than 1 per molecule, the molecular weight of the urea-modified polyester is reduced, and the hot-offset resistance may degrade.

Examples of the amines (B) include diamines (B1), trivalent or higher polyvalent polyamines (B2), aminoalcohols (B3), aminomercaptans (B4), amino acids (B5) and amines (B6) obtained by blocking the amino groups of B1 to B5. Examples of the diamines (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.). Examples of the trivalent or higher polyvalent polyamines (B2) include diethylenetriamine and triethylenetetramine. Examples of the aminoalcohols (B3) include ethanolamine and hydroxyethylaniline. Examples of the aminomercaptans (B4) include aminoethylmercaptan and aminopropylmercaptan. Examples of the amino acids (B5) include aminopropionic acid and aminocaproic acid. Examples of the amines (B6) obtained by blocking the amino groups of B1 to B5 include ketimine compounds obtained from the amines of B1 to B5 and ketones (acetone, methyl ethyl ketone, methyl isobutyl ketone, etc.), and oxazolidine compounds. Among these amines (B), preferred are a B1 and a mixture of a B1 and a small amount of a B2.

Further as required, the molecular weight of a urea-modified polyester can be controlled using an elongation terminator. Examples of the elongation terminator include monoamines (diethylamine, dibutylamine, butylamine, laurylamine, etc.) and monoamines (ketimine compounds) obtained by blocking them.

The ratio of the amines (B) in terms of the equivalent ratio (NCO)/(NHx) of the isocyanate group (NCO) in a prepolymer (A) having isocyanate groups to the amino group (NHx) in the amines (B), is preferably 1/2 to 2/1, more preferably 1.5/1 to 1/1.5, still more preferably 1.2/1 to 1/1.2. With the ratio (NCO)/(NHx) more than 2 and of less than 1/2, the molecular weight of the urea-modified polyester decreases and the hot offset resistance may degrade.

In the present invention, a polyester (i) modified with a urea bond may contain a urethane bond together with the urea bond. The molar ratio of the urea bond content to the urethane bond content is preferably 100/0 to 10/90, more preferably 80/20 to 20/80, still more preferably 60/40 to 30/70. The molar ratio of the urea bond is less than 10%, the hot offset resistance may degrade.

Through the above-mentioned reaction, modified polyesters for use in the present invention, in particular, a urea-modified polyester (i) for use in the present invention can be produced. The urea-modified polyester (i) can be produced by a one-shot method, a prepolymer method, or the like. The mass average molecular weight of the urea-modified polyester (i) is preferably 10,000 or higher, more preferably 20,000 to 10,000,000, still more preferably 30,000 to 1,000,000. With the mass average molecular weight lower than 10,000, the hot offset resistance may degrade.

The number average molecular weight of the urea-modified polyester (i), when it is obtained using the after-mentioned unmodified polyester (ii), is not particularly limited, and may be such a number average molecular weight that the above-described mass average molecular weight is easily obtained. The number-average molecular weight in the case of using singly a urea-modified polyester (i) is preferably 20,000 or lower, more preferably 1,000 to 10,000, still more preferably 2,000 to 8,000. With the number average molecular weight exceeding 20,000, the low-temperature fixability may degrade, and in the case of use in a full-color machine (image forming apparatus), the glossiness of images obtained from the machine may degrade.

In the present invention, a urea-modified polyester (i) may be used not only singly, but may be contained concurrently with an unmodified polyester (ii) as a binder resin component. The concurrent use of (ii) improves the low-temperature fixability, and the glossiness in the case of use in a full-color machine (image forming apparatus), and is more preferable than the single use. Examples of the unmodified polyester (ii) include polycondensates of a polyol (1) with a polycarboxylic acid (2) similar to the polyester components of the above-mentioned urea-modified polyester (i), and the preferable ones are similar to the case of the urea-modified polyester (i). The urea-modified polyester (i) can be used concurrently not only with an unmodified polyester (ii), but also with a polyester modified with a chemical bond other than urea bond, for example, a polyester modified with a urethane bond. That urea-modified polyester (i) and unmodified polyester (ii) being miscible at least partially with each other is preferable in view of the low-temperature fixability and the hot offset resistance.

Therefore, the polyester components of (i) and (ii) preferably have analogous compositions. The mass ratio of urea-modified polyester (i) and the unmodified polyester (ii) in the case of concurrent use of the unmodified polyester (ii) is preferably 5/95 to 80/20, more preferably 5/95 to 30/70, still more preferably 5/95 to 25/75, particularly preferably 7/93 to 20/80. With the mass ratio of (i) less than 5% by mass, the hot offset resistance degrades and there also arises a disadvantage in the simultaneous satisfaction of both the heat resistant storage stability and the low-temperature fixability.

The peak molecular weight of the unmodified polyester (ii) is preferably 1,000 to 30,000, more preferably 1,500 to 10,000, still more preferably 2,000 to 8,000. With the peak molecular weight lower than 1,000, the heat resistant storage stability may degrade, and with the peak molecular weight exceeding 10,000, the low-temperature fixability may degrade. The unmodified polyester (ii) preferably has a hydroxyl value of 5 mgKOH/g or more, more preferably of 10 mgKOH/g to 120 mgKOH/g, still more preferably of 20 mgKOH/g to 80 mgKOH/g. With the hydroxyl value less than 5 mgKOH/g, a disadvantage may be brought in the simultaneous satisfaction of both the heat resistant storage stability and the low-temperature fixability. The unmodified polyester (ii) preferably has an acid value of 1 mgKOH/g to 30 mgKOH/g, more preferably of 5 mgKOH/g to 20 mgKOH/g. Having an acid value easily exhibits the negative chargeability.

The glass transition temperature (Tg) of the binder resin is preferably 50° C. to 70° C., more preferably 55° C. to 65° C. With the glass transition temperature (Tg) lower than 50° C., blocking may occur during storage of the resulting toner at high temperature. With the Tg exceeding 70° C., the low-temperature fixability may be insufficient. By making the binder resin coexist with a urea-modified polyester resin, the toner used in the present invention exhibits favorable heat resistant storage stability as compared to known polyester-based toners, even when the glass transition temperature of the binder resin is low.

A temperature (TG') of the binder resin at which the storage elastic modulus of the binder resin measured at a frequency of 20 Hz becomes 10,000 dyne/cm$^2$ is preferably 100° C. or higher, more preferably 110° C. to 200° C. With the temperature (TG') lower than 100° C., the hot offset resistance may degrade.

A temperature (Tη) of the binder resin at which the viscosity of the binder resin measured at a frequency of 20 Hz becomes 1,000 poises is preferably 180° C. or lower, more preferably 90° C. to 160° C. With the temperature (Tη) exceeding 180° C., the low-temperature fixability degrades. That is to say, from the viewpoint of the simultaneous satisfaction of both the low-temperature fixability and the hot offset resistance, the temperature (TG') is preferably higher than the temperature (Tη). Or to put it another way, a difference of TG' minus Tη (TG'−Tη) is preferably 0° C. or higher, more preferably 10° C. or higher, still more preferably 20° C. or higher. The upper limit of the temperature difference is not particularly limited. Further, from the viewpoint of the simultaneous satisfaction of both the heat resistant storage stability and the low-temperature fixability, the temperature difference (TG'−Tη) is preferably 0° C. to 100° C., more preferably 10° C. to 90° C., still more preferably 20° C. to 80° C.

The binder resin can be produced by the following method, etc.

Firstly, the polyol (1) and the polycarboxylic acid (2) are heated to 150° C. to 280° C. in the presence of a known esterifying catalyst such as tetrabutoxy titanate or dibutyltin oxide, and the generated water is distilled away under reduced pressure as required to obtain a polyester having a hydroxyl value. Next, the resulting polyester is reacted with a polyisocyanate (3) at 40° C. to 140° C. to obtain a prepolymer (A) having an isocyanate group. Further, the prepolymer (A) is reacted with amines (B) at 0° C. to 140° C. to obtain a polyester modified with a urea bond. During the reaction of the polyisocyanate (3) and the reaction between (A) and (B), a solvent may be used if necessary.

Examples of the usable solvent include aromatic solvents (toluene, xylene, etc.); ketones (acetone, methyl ethyl ketone, methyl isobutyl keton, etc.); esters (ethyl acetate, etc.); amides (dimethylformamide, dimethylacetoamide, etc.), and solvents which are inactive to the isocyanate (3), such as esters (tetrahydrofuran, etc.).

In the case of using the urea-modified polyester (i) in combination with the urea-unmodified polyester (ii), the urea-unmodified polyester (ii) is produced in a similar manner to that used in the polyester having a hydroxyl group, and the reaction product is dissolved in and mixed with the solution after completion of a reaction of the urea-modified polyester (i).

The toner for use in the present invention can be produced according to the following method, but is not limited thereto.

The toner may be produced by reacting, in an aqueous medium, a dispersion containing a prepolymer (A) having an isocyanate group with amines (B), or using a urea-modified polyester (i) which has been produced beforehand. Examples of a method of forming, in an aqueous medium, the urea-modified polyester (i) or the dispersion containing the prepolymer (A) in a stable manner, include a method in which a composition of toner materials containing the urea-modified polyester (i) or the prepolymer (A) is added into an aqueous medium and dissolved therein under application of a shearing force.

The prepolymer (A), and a colorant, a coloring agent masterbatch, a releasing agent, a charge controlling agent, an unmodified polyester resin and the like which serve as other toner constituents (hereinbelow, otherwise referred to as "toner materials"), may be mixed at the time when the dispersion is formed in an aqueous medium, however, it is more preferred that the toner materials be preliminarily mixed and the mixture thus obtained be added to an aqueous medium to be dissolved therein. In the present invention, other toner materials such as a colorant, a releasing agent and a charge controlling agent are not necessarily mixed at the time of forming particles in the aqueous medium, they may be added to the aqueous medium after the formation of particles. For example, particles not containing colorants may be formed before addition of a colorant by a known dying method.

As the aqueous medium, water may be used singly, or may be used in combination with a solvent miscible with water. Examples of the solvent miscible with water include alcohols (methanol, isopropanol, ethylene glycol, etc.), dimethylformamide, tetrahydrofuran, cellosolves (methyl cellosolve, etc.), and lower ketones (acetone, methyl ethyl ketone, etc.).

The amount of use of the aqueous medium relative to 100 parts by mass of the toner composition containing the urea-modified polyester (i) or the prepolymer (A) is preferably 50 parts by mass to 2,000 parts by mass, more preferably 100 parts by mass to 1,000 parts by mass. With the use amount of the aqueous medium less than 50 parts by mass, the toner composition is not finely dispersed and toner particles having a desired particle size may not be obtained. With the use amount exceeding 2,000 parts by mass, it is undesirable in terms of cost efficiency.

Also, a dispersant may be used if necessary. It is preferable to use a dispersant in that the resulting toner has a sharp particle size distribution, and the toner materials are dispersed stably.

The dispersion method is not particularly limited and may be suitably selected in accordance with the intended use. For example, known dispersing machines such as a low-speed shearing type dispersing device, a high-speed shearing type dispersing device, a friction-type dispersing device, a high-pressure jet type dispersing device and a ultrasonic wave dispersing device can be suitably used. In order to make the dispersion have a particle diameter of 2 μm to 20 μm, it is preferred to use a high-speed shearing type dispersing device. When a high-speed shearing type dispersing device is used, the number of revolutions is not particularly limited, however, it is preferably 1,000 rpm to 30,000 rpm, more preferably 5,000 rpm to 20,000 rpm. The dispersion time period is not particularly limited, however, in the case of a batch process, it is commonly 0.1 minutes to 5 minutes. The dispersion temperature is preferably 0° C. to 150° C., more preferably 40° C. to 98° C. High dispersion temperature is preferable in that the viscosity of the resulting dispersion containing the urea-modified polyester (i) or the prepolymer (A) is low, and the toner composition is easily dispersed.

In the process of synthesizing the urea-modified polyester (i) from the prepolymer (A), amines (B) may be added to the toner composition to initiate a reaction before the toner composition is dispersed in an aqueous medium, or amines (B) may be added to the aqueous medium, in which the toner composition has been dispersed, so that a reaction is initiated at the interface of toner particles. On that occasion, a urea-modified polyester is preferentially generated on the surface of a toner to be produced, and a concentration gradient may be provided inside the toner particles.

In the reaction, it is desired to use a dispersant as required.

The dispersant is not particularly limited and may be suitably selected in accordance with the intended use. Examples thereof include surfactants, an inorganic compound dispersant sparsely soluble in water, and a polymeric protection colloid. These may be used alone or in combination. Among these, surfactants are preferable.

Examples of the surfactants include anionic surfactants, cationic surfactants, nonionic surfactants, and amphoteric surfactants.

Examples of the anionic surfactants include alkylbenzene sulfonic acid salts, α-olefin sulfonic acid salts, and phosphate esters. Among these, preferred are anionic surfactants having a fluoroalkyl group. Specific examples of the anionic surfactants having a fluoroalkyl group include, fluoroalkyl carboxylic acids having 2 to 10 carbon atoms and metal salts thereof, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propane sulfonate, fluoroalkyl(C11-C20) carboxylic acids and metal salts thereof, perfluoroalkylcarboxylic acids (C7-C13) and metal salts thereof, perfluoroalkyl(C4-C12) sulfonate and metal salts thereof, perfluorooctanesulfonic acid diethanol amides, N-propyl-N-(2-hydroxyethyl)perfluorooctanesulfone amide, perfluoroalkyl(C6-C10)sulfone amidepropyltrimethyl ammonium salts, salts of perfluoroalkyl (C6-C10)-N-ethylsulfonylglycin, monoperfluoroalkyl(C6-C16)ethylphosphates, etc. Specific examples of commercially available products of the surfactants having a fluoroalkyl group include SURFLON S-111, S-112, and S-113 (produced by Asahi Glass Co., Ltd.); FLUORAD FC-93, FC-95, FC-98, and FC-129 (produced by Sumitomo 3M Ltd.); UNIDYNE DS-101, and DS-102 (produced by Daikin Industries, Ltd.); MEGAFACE F-110, F-120, F-113, F-191, F-812, and F-833 (produced by Dainippon Ink & Chemicals Inc.); EFTOP EF-102, 103, 104, 105, 112, 123A, 123B, 306A, 501, 201, and 204 (produced by Tohchem Products Co., Ltd.); and FTERGENT F-100, and F150 (produced by Neos Co., Ltd.).

Examples of the cationic surfactants include amine salts type surfactants, and quaternary ammonium salts type-cationic surfactants. Specific examples of the amine salts type surfactants include alkyl amine salts, aminoalcohol fatty acid derivatives, polyamine fatty acid derivatives, and imidazoline. Specific examples of the quaternary ammonium salts type-cationic surfactants include alkyltrimethyl ammonium salts, dialkyldimethyl ammonium salts, alkyldimethylbenzyl ammonium salts, pyridinium salts, alkylisoquinolinium salts, and benzethonium chloride. Among these cationic surfactants, preferred are aliphatic primary, secondary or tertiary amine acids, aliphatic quaternary ammonium salts (e.g. perfluoroalkyl(C6-C10) sulfoneamidepropyltrimethyl ammonium salts), benzalkonium salts, benzethonium chloride, pyridinium salts, and imidazolinium salts. Specific examples of commercially available products of the cationic surfactants include SURFLON S-121 (produced by Asahi Glass Co., Ltd.); FLUORAD FC-135 (produced by Sumitomo 3M Ltd.); UNIDYNE DS-202 (produced by Daikin Industries, Ltd.); MEGAFACE F-150, and F-824 (produced by Dainippon Ink & Chemicals Inc.); EFTOP EF-132 (produced by Tohchem Products Co., Ltd.); and FTERGENT F-300 (produced by Neos Co., Ltd.).

Examples of the nonionic surfactants include fatty acid amide derivatives, and polyhydric alcohol derivatives.

Examples of the amphoteric surfactants include alanine, dedecyldi(aminoethyl)glycin, di(octylaminoethyl)glycin, and N-alkyl-N,N-dimethylammonium betaine.

Examples of the inorganic compound dispersant sparsely soluble in water include tricalcium phosphate, calcium carbonate, titanium oxides, colloidal silica, and hydroxyapatite.

Examples of the polymeric protection colloid include acids, (meth)acrylic monomers containing a hydroxyl group, vinyl alcohols, ethers of vinyl alcohols, esters of vinyl alcohol with a compound having a carboxyl group, amide compounds or methylol compounds thereof, chlorides, homopolymers or copolymers having a nitrogen atom or heterocyclic ring having a nitrogen atom, polyoxyethylene compounds, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic acid esters, diethyleneglycol monomethacrylic acid esters, glycerin monoacrylic acid esters, N-methylolacrylamide, and N-methylolmethacrylamide. Examples of the vinyl alcohol and ethers thereof include vinyl methyl ether, vinyl ethyl ether, and vinyl propyl ether. Examples of esters of vinyl alcohol with a compound having a carboxyl group include vinyl acetate, vinyl propionate, and vinyl butyrate. Examples of amide compounds or methylol compounds thereof include acrylamide, methacrylamide, and diacetoneacrylamide, and their methylol compounds. Examples of the chlorides include acrylic acid chloride, and methacrylic acid chloride. Examples of the homopolymers and copolymers having a nitrogen atom or a heterocyclic ring having a nitrogen atom include vinyl pyridine, vinyl pyrrolidone, vinyl imidazole, and ethylene imine. Examples of the polyoxyethylene compounds include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Examples of the celluloses include methyl cellulose, hydroxyethyl cellulose, and hydroxypropyl cellulose.

In the preparation of the dispersion liquid, a dispersion stabilizer can be used as required. Examples of the dispersion stabilizer include dispersion stabilizers soluble in acid and alkali, such as calcium phosphate salt.

When the dispersion stabilizer is used, calcium phosphate salt is dissolved in fine particles using an acid such as hydrochloric acid, and then the fine particles are washed with water or resolved with enzyme to thereby remove the calcium phosphate from the fine particles.

In the preparation of the dispersion liquid, the catalyst for elongation and/or crosslinking reaction can be used. Examples of the catalyst include dibutyltin laurate, and dioctyltin laurate.

Further, a solvent capable of dissolving the urea-modified polyester (i) and the prepolymer (A) can also be used in order to reduce the viscosity of the toner composition. It is preferred to use a solvent in that the resulting toner has a sharp particle size distribution. The solvent is preferably volatile in that it can be easily removed.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination. Among these, preferred are aromatic solvents such as toluene and xylene; and hydrocarbon halides such as methylene chloride, 1,2-dichloroethane, chloroform and carbon tetrachloride; and more preferred are aromatic solvents such as toluene and xylene.

The amount of use of the solvent relative to 100 parts by mass of the prepolymer (A) is preferably 0 parts by mass to 300 parts by mass, more preferably 0 parts by mass to 100 parts by mass, still more preferably 25 parts by mass to 70 parts by mass. When the solvent is used in the toner composition, the toner composition is heated under normal pressure or reduced pressure after being subjected to an elongation and/or crosslinking reaction, so that the solvent is removed therefrom.

The elongation and/or crosslinking reaction time is adjusted depending on the reactivity achieved by a combination of an isocyanate group structure possessed by the prepolymer (A) and amines (B). The reaction time is however preferably 10 minutes to 40 hours, more preferably 2 hours to 24 hours. The reaction temperature is preferably 0° C. to 150° C., more preferably 40° C. to 98° C. In addition, a known catalyst can be used as required. Specific examples of the catalyst are dibutyltin laurate, and dioctyltin laurate.

In order to remove the organic solvent from the resulting emulsified dispersion, a method can be used in which the temperature of the entire system is gradually increased to completely evaporate and remove the organic solvent in the dispersion droplets from the entire system. Alternatively, the emulsified dispersion may be sprayed in a dry atmosphere to completely remove a nonaqueous solvent in the dispersion droplets while evaporating the aqueous dispersion therein so as to be removed, thereby forming toner fine particles. As the dry atmosphere in which the emulsified dispersion is sprayed, commonly used are heated gases, such as heated air, heated nitrogen gas, heated carbon dioxide gas, and heated combustion gas; and especially used are various air streams which are heated to a temperature higher than the boiling point of the solvent having the highest boiling point. An emulsified dispersion can be obtained with a satisfactory quality by spraying treatment, in a short time, using a spray dryer, a belt dryer or a rotary kiln.

When the emulsified dispersion has a wide particle size distribution in the emulsification/dispersion treatment and is subjected to washing and drying while maintaining its particle size distribution, the emulsified dispersion can be classified so as to have a desired particle size distribution.

The classification treatment can be carried out in the dispersion liquid by means of a cyclone, a decanter, a centrifugal separator or the like. With this classification treatment, microparticle fractions can be removed. The toner particles may be dried so as to be a dried powder before being subjected to a classification treatment, however, in terms of production efficiency, it is preferable to carry out the classification treatment in the dispersion liquid. Obtained unnecessary fine particles or coarse particles can be brought back to the kneading process to be used in the formation of the particles. At this stage, the finer particles and coarse particles may be wet.

Preferably, the dispersant should be removed from the resulting dispersion liquid as much as possible, more preferably, the removal of the dispersant is carried out simultaneously with the classification treatment described above.

The resultant dried toner powder is mixed with different kinds of fine particles of a release agent, a charge controlling agent, a fluidizing agent, a coloring agent, etc., and if necessary, mechanical impact force is applied to the mixed powder so as to fix the fine particles on surfaces of the toner particles and fuse them for obtaining composite particles. Thus, it is possible to prevent different kinds of particles from escaping from surfaces of the composite particles.

Specifically, there are provided (1) a method of applying an impact force to the mixture using a blade that rotates at high speed; and (2) a method of throwing the mixture into a high speed gas flow so that the mixture is accelerated and both the toner particles and the fine particles or the composite particles collide with an appropriate collision plate. As apparatuses for implementing the methods, provided are Angmill (manufactured by Hosokawa Micron Corporation) and I-type mill (manufactured by Nippon Pneumatic Mfg. Co., Ltd.) that are adapted to drop air pressure for milling, Hybridization System (manufactured by Nara Machinery Co., Ltd.), Kryptron System (manufactured by Kawasaki Heavy Industries, Ltd.), and an automatic mortar, etc.

As a colorant for use in the toner, pigments and dyes that have been used as toner colorants may be used. Specific examples of the colorants include carbon black, lamp black, black iron oxide, ultramarine blue, Nigrosine dyes, aniline blue, phthalocyanine blue, phthalocyanine green, Hansa Yellow G, Rhodamine 6C Lake, Calconyl Blue, chrome yellow, quinacridone red, benzidine yellow, and rose Bengal. These may be used alone or in the form of a mixture.

Further, if necessary, in order to make toner particles have magnetic properties, magnetic components, for example, iron oxides (e.g. ferrite, magnetite, maghemite etc.); metals (e.g. iron, cobalt, nickel, etc.), or alloys of these metals with other metals may be used singly or in the form of a mixture, to be contained in the toner particles. These magnetic components can be used as colorant components.

The number average particle diameter of the colorant for use in the toner of the present invention is preferably 0.5 μm or smaller, more preferably 0.4 μm or smaller, still more preferably 0.3 μm or smaller. With the number average particle diameter greater than 0.5 μm, the dispersibility of the pigment does not have a satisfactory dispersibility and favorable transparency may not be obtained. In contrast, in the case of a colorant having a number average particle diameter smaller than 0.1 μm, it is conceivable that the colorant does not adversely affect the light reflection and light absorbance, because it is much smaller in size than one-half wavelength of visible light. Therefore, a colorant having a number average particle diameter smaller than 0.1 μm contributes to favorable color-reproducibility and the transparency of an OHP sheet with a fixed image formed on a surface thereof. Meanwhile, when a colorant having a number average particle diameter greater than 0.5 μm is present in a large amount in the toner particles, transmission of incident light is blocked and/or diffused, resulting in a tendency of the color brightness and color saturation of an image projected on an OHP sheet to degrade. In addition, when a colorant having a number average particle diameter greater than 0.5 μm is present in a large amount, the colorant (particles) escape from the surfaces of toner particles, possibly leading to various troubles such as fogging, contamination on a photoconductor drum, cleaning defects, and the like. The amount of a colorant having a number average particle diameter greater than 0.7 μm relative to the total amount of the colorant is preferably 10 number % or less, more preferably 5 number % or less.

Also, by kneading the colorant, into which a wetting liquid has been added, together with a part or the whole of a binder resin in advance, the binder resin and the colorant are sufficiently attached to each other in an early stage, and the dispersion of the colorant in toner particles in subsequent toner production processes is effectively performed, and thereby the colorant has a small dispersed particle diameter, and further favorable transparency can be obtained.

As the binder resin for use in the preliminary kneading, the resins exemplarily described above as binder resins for toner may be used as they are, but are not limited to those described.

As a specific method of kneading a mixture of the binder resin and the colorant together with the wetting liquid in advance, for example, the binder resin, colorant and wetting liquid are mixed in a blender, such as a HENSCHEL MIXER, and then the resultant mixture is kneaded with a kneader, such as a two-roll, and triple roll kneader at a temperature lower than the melting temperature of the binder resin to thereby obtain a kneaded sample.

As the wetting liquid, a generally used wetting agent is used in consideration of the solubility of the binder resin and the coatability of the binder resin with the colorant. Preferred are organic solvents such as acetone, toluene, butanone: and water, from the aspect of the dispersibility of the colorant. Among these, use of water is particularly preferable in terms of environmental protection and maintaining the dispersion stability of the colorant in subsequent toner production processes.

Through this production method, not only the size of colorant particles to be contained in the resulting toner is made smaller, but also the homogeneity of dispersed particles is enhanced, resulting in further improvement of the color-reproducibility of an image projected on an OHP sheet.

Preferably, the toner contains a releasing agent, in addition to the binder resin and the colorant.

The releasing agent is not particularly limited and may be suitably selected from among those known in the art, in accordance with the intended use. Examples thereof include polyolefin waxes (e.g. polyethylene wax, polypropylene wax, etc.); long-chain hydrocarbons (paraffin wax, Sazol wax, etc.); and carbonyl group-containing waxes. Among these, particularly preferred are carbonyl group-containing waxes.

Examples of the carbonyl group-containing waxes include polyalkanoic acid esters (carnauba wax, montan wax, trimethylolpropane tribehenate, pentaerithritol tetrabehenate, pentaerithritol diacetatedibehenate, glycerin behenate, 1,18-octadecanedioldistearate, etc.); polyalkanol esters (e.g. trimellitic tristearate, distearyl maleate, etc.); polyalkanoic amides (ethylenediamine dibehenylamide, etc.); polyalkylamides (trimellitic tristearylamide, etc.); and dialkylketones (distearylketone, etc.). Among these, particularly preferred are polyalkanol esters.

The melting point of the releasing agent is preferably 40° C. to 160° C., more preferably 50° C. to 120° C., still more preferably 60° C. to 90° C. When the melting point is lower than 40° C., it may adversely affect the heat resistant storage stability, and with the meting point exceeding 160° C., cold offset easily takes place at the time of fixing at low temperature.

The melt viscosity of the releasing agent is 20° C. higher than the melting point thereof, and preferably 5 cps to 1,000 cps, more preferably 10 cps to 100 cps. With the melt viscosity exceeding 1,000 cps, the effect of improving the hot offset resistance and low-temperature fixability may be insufficient.

The amount of the releasing agent in the toner is preferably 40% by mass or less, more preferably 3% by mass to 30% by mass.

To accelerate the charge rising time of the toner, a charge controlling agent may be contained in the toner as required. When as the charge controlling agent, a colored material is used, a color-change occurs in the toner. Thus, it is preferred to use a colorless or translucent white material for the charge controlling agent.

The charge controlling agent is not particularly limited and may be suitably selected from among those known in the art.

Examples thereof include triphenylmethane dyes, molybdic acid chelate pigments, rhodamine dyes, alkoxy-based amines, quaternary ammonium salts (including fluorine-modified quaternary ammonium salt), alkylamides, a single substance of phosphorus or compound thereof, a single substance of tungsten or compound thereof, fluorochemical surfactants, salicylic acid metal salts, and metal salts of salicylic acid derivatives.

As the charge controlling agent, commercially available products can be used. Examples of the commercially available products include BONTRON P-51 of a quaternary ammonium salt, E-82 of an oxynaphthoic acid-based metal complex, E-84 of a salicylic acid-based metal complex, and E-89 of a phenolic condensate (produced by ORIENT CHEMICAL Co. Ltd.); TP-302 and TP-415 of a quaternary ammonium salt molybdenum complex (produced by HODOGAYA CHEMICAL Co., Ltd.); COPY CHARGE PSY VP2038 of a quaternary ammonium salt, COPY BLUE PR of a triphenyl methane derivative, COPY CHARGE NEG VP2036 of a quaternary ammonium salt, COPY CHARGE NX VP434 (produced by Hoechst AG); LRA-901 and LR-147 of a boron complex (produced by NIPPON CARLIT); quinacridone, and azo pigments; and other polymer compounds having a functional group such as sulfonic group, carboxyl group, quaternary ammonium salt or the like. These may be used alone or in combination.

The additive amount of the charge controlling agent differs depending on the kind of binder resin, and the toner production processes including the presence or absence of additives and dispersion method, and therefore, is not unequivocally defined. However, it is preferably 0.1 parts by mass to 10 parts by mass, more preferably 0.2 parts by mass to 5 parts by mass relative to 100 parts by mass of the binder resin. With the additive amount exceeding 10 parts by mass, the effect of the charge controlling agent decreases due to excessive chargeability of the toner, and the electrostatic attraction force of the toner is increased with respect to the developing roller used, possibly leading to degradation of flowability of the developer and a decrease in image density. These charge controlling agent may be melt-kneaded together with the masterbatch and resins and then dissolved and/or dispersed in an organic solvent, or may be directly dissolved in an organic solvent and added in an aqueous medium when the toner composition is dispersed therein, or may be fixed on the surface of the toner after toner particles have been produced.

Also, resin fine particles for mainly obtaining dispersion stability may be added in the aqueous medium when the toner composition is dispersed therein.

As the resin fine particles, any resins may be used as long as they are capable of forming an aqueous dispersion. The resin fine particles may be of thermoplastic resin or thermosetting resin. For example, there are exemplified vinyl resins, polyurethane resins, epoxy resins, polyester resins, polyamide resins, polyimide resins, silicon resins, phenolic resins, melamine resins, urea resins, aniline resins, ionomer resins, and polycarbonate resins. These may be used alone or in combination. Among these, preferred are vinyl resins, polyurethane resins, epoxy resins, polyester resins and a combination thereof, in that an aqueous dispersion of spherical-shaped fine particles can be easily obtained therefrom.

As the vinyl resin, polymer obtained by homopolymerization or copolymerization of vinyl monomer is used. Examples thereof include styrene-(meth)acrylate resin, styrene-butadiene copolymers, (meth)acrylic acid-acrylic ester polymers, styrene-acrylonitrile copolymers, styrene-maleic anhydride copolymers, and styrene-(meth)acrylic acid copolymers.

As an external additive to enhance the flowability, developability and chargeability of toner particles, inorganic fine particles are suitable.

Examples of the inorganic fine particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride. These inorganic fine particles may be used alone or in combination.

The primary particle diameter of the inorganic fine particles is preferably in the range of from 5 nm to 2 more preferably in the range of 5 nm to 500 nm. The specific surface area of the inorganic fine particles measured by the BET method is preferably in the range of 20 $m^2/g$ to 500 $m^2/g$. The amount of the inorganic fine particles added to the toner is preferably 0.01% by mass to 5% by mass, more preferably 0.01% by mass to 2.0% by mass.

There may be also exemplified polystyrenes, methacrylate or acrylate copolymers obtained by soap-free emulsification polymerization, suspension polymerization or dispersion polymerization; polycondensates such as silicone, benzoguanamine and nylon; and polymer particles formed of thermosetting resins.

A fluidizing agent is also added to the toner. The fluidizer is subjected to surface treatment so as to enhance the hydrophobicity thereof, so that the fluidity and the electrostatic chargeability of the toner are prevented from degrading even under high humidity condition. As the fluidizer, provided are, for example, silane-coupling agents, silylation agents, silane-coupling agent containing a fluoroalkyl group, organic titanate-based coupling agents, silicone oil, and modified silicone oils, etc.

As a cleanability improver for removing a developer remaining on surfaces of a photoconductor and an intermediate transfer member after a transfer process, there may be exemplified metal soaps such as zinc stearate, calcium stearate and stearic acid; and polymer fine particles produced by soap-free emulsification polymerization, such as polymethyl methacrylate fine particles and polystyrene fine particles. Preferred polymer fine particles have a relatively narrow particle size distribution and a volume average particle diameter of 0.01 μm to 1 μm.

The use of such a toner that has superior developing stability makes it possible to form a high-quality toner image.

In the meanwhile, the image forming apparatus of the present invention is not only applicable to a polymerized toner having a composition suitable in obtaining a high-quality image as described above but also applicable to an indefinitely shaped toner (toner particles) which is obtained by pulverization. In the case of using such a pulverization toner, the operating life of the image forming apparatus can be significantly prolonged. As materials constituting such a pulverization toner, materials generally used for an electrophotographic toner can be used without particular limitation.

Specific examples of the binder resin for use in the pulverization toner include styrenes such as polystyrene, poly-p-chlorostyrene, and polyvinyltoluene and substituted polymers thereof, styrene copolymers such as a styrene-p-chlorostyrene copolymer, styrene-propylene copolymer, styrene-vinyltoluene copolymer, styrene-vinylnaphthaline copolymer, styrene-methylacrylate copolymer, styrene-ethylacrylate copolymer, styrene-butylacrylate copolymer, styrene-octyl acrylate copolymer, styrene-methylmethacrylate copolymer, styrene-ethylmethacrylate copolymer, styrenebutylmethacrylate copolymer, styrene-α-chloromethylmethacrylate copolymer, styrene-acrylonitrile copolymer, styrene-vinylmethylketone copolymer, styrene-butadiene copolymer, styrene-isoprene copolymer, and styrene-maleate copolymer; acrylate polymers such as polymethylacrylate, polybutylacrylate, polymethylmethacrylate and polybutylmethacrylate and copolymers thereof; polyvinyl derivatives such as polyvinyl chloride, and polyvinyl acetate; polyester polymers, polyurethane polymers, polyamide polymers, polyimide polymers, polyol polymers, epoxy polymers, terpene polymers, aliphatic or alicyclic hydrocarbon resins, and aromatic petroleum resins. These may be used alone or in combination. Among these, preferred are styrene-acrylate copolymer resins, polyester resins and polyol resins from the viewpoint of electrical properties and cost performance. As those having favorable fixability, polyester resins and polyol resins are particularly preferable.

In the toner produced by pulverization, a pulverization toner may be produced as follows: the above mentioned colorant component, wax component and charge controlling component etc. are pre-mixed with these resin components and then kneaded at a temperature in the vicinity of the melting temperature of the resin components, subjected to cooling and pulverization/classification process. In addition, if necessary, the external additive component may be added in an appropriate amount and mixed therein.

The developing unit may employ a dry developing process or may employ a wet developing process. Further, the developing unit may be a monochrome developing unit or may be a multi-color developing unit. Preferably, a developing unit is exemplified which has a stirrer that can frictionally stir the toner or the developer so as to be charged, and a rotatable magnet roller.

In the developing unit, for example, the toner and a carrier are mixed and agitated, which causes a friction to charge the toner and maintains the charged toner in a state of being held vertically on a surface of the rotating magnet roller to form a magnetic brush thereon. The magnet roller is set near the photoconductor, therefore, a part of the toner constituting the magnetic brush formed on the surface of the magnetic roller transfers to the surface of the photoconductor by electrical attraction. As a result, the latent electrostatic image is developed using the toner, and a visible image formed of the toner is then formed on the surface of the photoconductor.

The developer to be housed in the developing unit is a developer containing the toner of the present invention, and it may be a one-component developer or may be a two-component developer.

<Transferring Step and Transfer Unit>

The transferring step is a step of transferring the visible image onto a recording medium and is carried out by means of a transfer unit. The transfer unit is broadly classified into a transfer unit where a visible image on a latent electrostatic image bearing member is directly transferred onto a recording medium, and a secondary transfer unit where a visible image is primarily transferred onto an intermediate transfer member and then the visible image is secondarily transferred onto the recording medium. In a preferred aspect of the transferring step, an intermediate transfer member is used, and a visible image is primarily transferred onto the intermediate transfer member and then secondarily transferred onto a recording medium. In a more preferred aspect of the transferring step, as the toner, two or more color toners, preferably full-color toners are used, a visible image is primarily transferred onto an intermediate transfer member to form a composite transfer image, and then the composite transfer image secondarily transferred onto a recording medium.

The visible-image transfer may be carried out, for example, by charging the photoconductor using a transfer charger, which may be performed by the transfer unit. In a preferred aspect, the transfer unit has a primary transfer unit that transfers the visible image to the intermediate transfer member to form a composite transfer image, and a secondary transfer unit that transfers the compounded transfer image to the recording medium.

The intermediate transfer member is not particularly limited and may be suitably selected from among conventional transfer members in accordance with the intended use. Preferred examples thereof include transfer belts.

The photoconductor may be an intermediate transfer member which is used in image formation based on a so-called intermediate transfer process in which a toner image formed on a photoconductor is primarily transferred so as to superpose colors, and the color-superposed toner image is further transferred onto a recording medium.

-Intermediate Transfer Member-

The intermediate transfer member preferably exhibits conductivity of a volume resistivity of $1.0\times10^{5}$ Ω·cm to $1.0\times10^{11}$ Ω·cm. When the volume resistivity is lower than $1.0\times10^{5}$ Ω·cm, it may cause so-called transfer dust where a toner image is disturbed due to electrostatic discharge caused when the toner image is transferred from a photoconductor to an intermediate transfer member. When the volume resistivity is higher than $1.0\times10^{11}$, an opposite charge to the toner image remains on the intermediate transfer member after the toner image has been transferred from the intermediate transfer member to a recording medium such as paper, and the opposite charge may appear as an afterimage on a subsequent image.

As the intermediate transfer member, for example, a belt-shaped or cylindrical plastic or the like can be used which is formed by using, for example, a metal oxide such as tin oxide, and indium oxide; conductive particles such as carbon black; or a conductive polymer singularly or in combination, kneading the selected material with a thermoplastic resin, and extrusion-molding the kneaded mixture. Besides the above mentioned, it is possible to obtain an intermediate transfer belt in an endless belt form by adding the above-noted conductive particles and conductive polymer, if necessary, to a resin solution containing a thermally crosslinkable monomer and/or oligomer and stretch-molding the product under application of heat.

When a surface layer is formed on the surface of the intermediate transfer belt, it is possible to use a surface layer prepared by additionally using a conductive material in an appropriate amount with a composition containing the above-mentioned materials used in the surface layer of the photoconductor, but excluding charge transporting materials, so as to control the resistivity.

The transfer unit (the primary and secondary transfer units) preferably includes a transfer device or transcriber for separating the visible image formed on the photoconductor to be charged onto the recording medium side. The transferring unit may include a single unit or two or more units. Examples of the transcriber include a corona transcriber utilizing corona discharge, transcription belt, a transcription roller, a pressure transcription roller, and an adhesion transcriber.

The recording medium is not particularly limited and may be suitably selected from among known recording media (recording papers).

<Protective Layer Forming Step and Protective Layer Forming Unit>

The protective layer forming step is a step of forming a protective layer by applying the above-mentioned protective agent onto the photoconductor after image transfer, using a protective layer forming unit.

As the protective layer forming unit, it is possible to use the above-described protective layer forming device of the present invention.

<Fixing Step and Fixing Unit>

The fixing step is a step of fixing a visible image transferred onto a recording medium by using the image fixing unit, and the fixing may be performed every time each individual color toners is transferred onto the recording medium or at a time in the condition where each individual color toners has been superimposed.

The fixing unit is not particularly limited and may be suitably selected in accordance with the intended use, however, a heat pressure unit known in the art is preferable. Examples of the heat pressure unit include a combination of a heat roller and a pressure roller, and a combination of a heat roller, pressure roller and an endless belt.

The heating temperature in the heat pressure unit is preferably 80° C. to 200° C.

Note that in the present invention, for example, an optical fixing device may be used together with the fixing and the fixing unit or instead of them, in accordance with the intended use.

The charge-eliminating is a step of eliminating electricity by applying charge-eliminating bias to the photoconductor, and it can be suitably performed by means of a charge-eliminating unit. The charge-eliminating unit is not particularly limited and may be required only to have the ability for applying charge-eliminating bias to the photoconductor, and may be suitably selected from among electricity eliminators known in the art. For example, a charge-eliminating lamp is preferably exemplified.

The cleaning step is a step of removing electrographic toner residues remaining on the photoconductor, and this can be suitably performed by means of a cleaning unit.

The cleaning unit is preferably placed on the downstream side of the transfer unit and on the upstream side of the protective layer forming unit.

The cleaning unit is not particularly limited, and is required only to have the ability for removing the electrophotographic toner residues remaining on the photoconductor. The cleaning unit may be suitably selected from cleaners known in the art such as a magnetic brush cleaner, an electrostatic brush cleaner, a magnetic roller cleaner, a blade cleaner, a brush cleaner, and a web cleaner.

The recycling step is a step of recycling the toner eliminated in the cleaning to the developing unit and can be carried out by means of a recycling unit. The recycling unit is not particularly limited, and preferred examples thereof include conveying units known in the art.

The controlling step is a step of controlling the above-mentioned individual steps, and this can be suitably performed by means of a controlling unit.

The controlling unit is not particularly limited and may be suitably selected in accordance with the intended use, provided that it can control the movements of the above noted individual units. Examples of the controlling unit include instruments such as sequencers, and computers.

Figure 3:
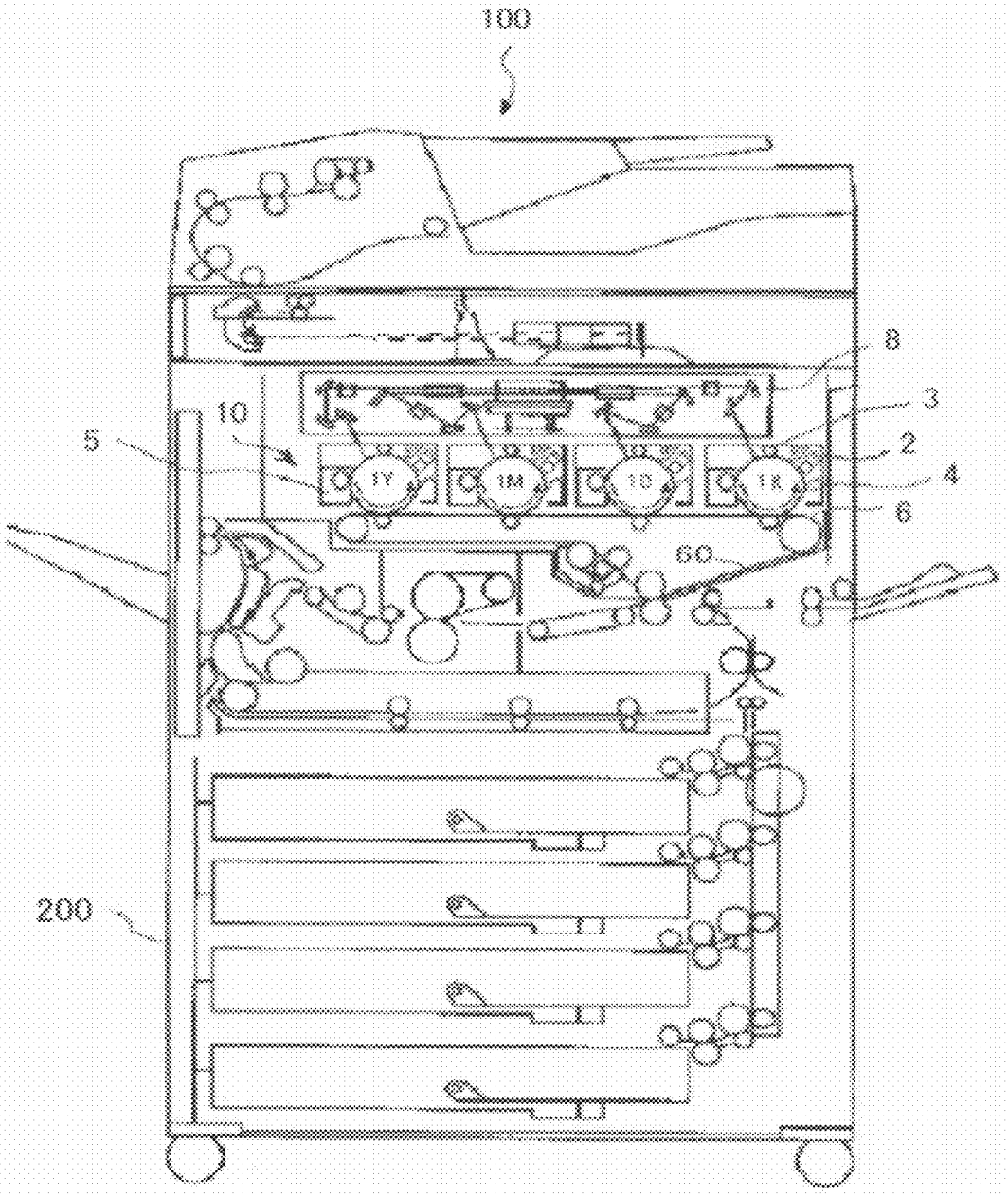
FIG. 3 is a schematic diagram showing one example of an image forming apparatus according to the present invention.

Here, FIG. 3 is a schematic diagram exemplarily showing an image forming apparatus 100 equipped with the protective layer forming device of the present invention.

A protective layer forming device 2, a charging device 3, a latent image-forming device 8, a developing device 5, an image transfer device 6, and a cleaning device 4 are arranged around each drum-shaped photoconductor 1Y, 1M, 1C, 1K, and image formation is performed according to the following manner.

Hereinafter, a series of processes of negative-positive image formation will be described.

An organic photoconductor (OPC) typified by a photoconductor having an organic photoconductive layer is subjected to charge elimination through a charge-eliminating lamp (not shown) or the like, and then the surface of the organic photoconductor is uniformly negatively charged by the charging device 3 having a charging member.

When the photoconductor is charged by the charging device 3, a voltage of an appropriate intensity suitable for charging each of the photoconductors 1Y, 1M, 1C, and 1K so as to have a desired potential, or a charge voltage with an alternating voltage being superimposed over the voltage is applied from a voltage applying mechanism (not shown) to the charging member.

On the charged photoconductors 1Y, 1M, 1C, and 1K, a latent image is formed using a laser beam irradiated from the latent image-forming device 8 such as a laser optical system (the absolute value of the potential at an exposed portion becomes lower than that of the potential at an unexposed portion).

The lease beam is emitted from a semiconductor laser and surfaces of the photoconductors 1Y, 1M, 1C, and 1K are scanned with the laser beam in a rotation axis direction of the photoconductors 1Y, 1M, 1C, and 1K, by means of a polygonal column-shaped polygon mirror which rotates at high speed.

The latent image thus formed is developed using a developer constituted by toner particles or a mixture of the toner particles and carrier particles which are supplied onto a development sleeve which serves as a developer bearing member and which is placed at the developing device 5, and thereby a toner visible image is formed.

When the latent image is formed, a voltage of appropriate intensity or a developing bias made by superimposing an AC voltage onto the voltage is applied from the voltage applying mechanism (not shown) to a development sleeve, with the intensity being between the intensities of the voltages for the exposed portion and the unexposed portion of the photoconductor photoconductors 1Y, 1M, 1C, and 1K.

Toner images formed on the photoconductors 1Y, 1M, 1C, and 1K for yellow, magenta, cyan and black respectively are transferred onto an intermediate transfer member 60 in a superimposed manner by transfer device 6, and the superimposed toner image (color image) is transferred onto a recording medium such as paper fed from a paper feed section 200.

On that occasion, the transfer device 6 is preferably applied with, as a transfer bias, an electric potential of a polarity opposite to that of the charged toner. Thereafter, the intermediate transfer member 60 is separated from the photoconductors 1Y, 1M, 1C, and 1K, and a transfer image is obtained.

Toner particles remaining on the photoconductors 1Y, 1M, 1C, and 1K are collected by a cleaning member so as to be recycled to a toner recycling section in the cleaning device 4.

The image forming apparatus may be an apparatus which is configured to have a plurality of the above-mentioned developing devices are arranged, so that a plurality of different color-toner images sequentially formed by the plurality of developing devices are then sequentially transferred onto a transfer material, and sent to a fixing mechanism to fix the toner on the transfer material by application of heat, or so that a plurality of toner images formed in the same manner as above are sequentially transferred onto an intermediate transfer member once, and then transferred onto a recording medium such as paper at one time, followed by fixing in the same manner as described above.

Further, the charging device 3 is preferably a charging device which is placed in contact with or close to the surface of the photoconductor. This makes it possible to greatly reduce the amount of ozone generated at the time of charging in comparison with corona dischargers using discharge wires, which are so-called corotron dischargers and scorotron dischargers.

It should, however, be noted that in a charging device which performs charging with a charging member placed in contact with or close to the surface of a photoconductor, since electric discharge is performed in the vicinity of the surface of the image bearing member as described above, there tends to be great electrical stress on the image bearing member. Use of a protective layer forming device utilizing the protective agent block of the present invention makes it possible to sustain the quality of a photoconductor over a long period of time without causing degradation of the photoconductor; hence, it is possible to greatly reduce temporal variation in the quality of images and variation in the quality of images caused by a use environment and thus to secure stable image quality.

(Process Cartridge)

The process cartridge of the present invention includes at least a photoconductor and the protective agent applying unit of the present invention and further includes other units such as a charging unit, an exposing unit, a developing unit, a transfer unit, a cleaning unit, a charge-eliminating unit etc., as necessary.

The process cartridge of the present invention is detachably mounted on a variety of electrophotographic apparatuses. Preferably, it is detachably mounted on the above-mentioned image forming apparatus of the present invention.

Figure 4:
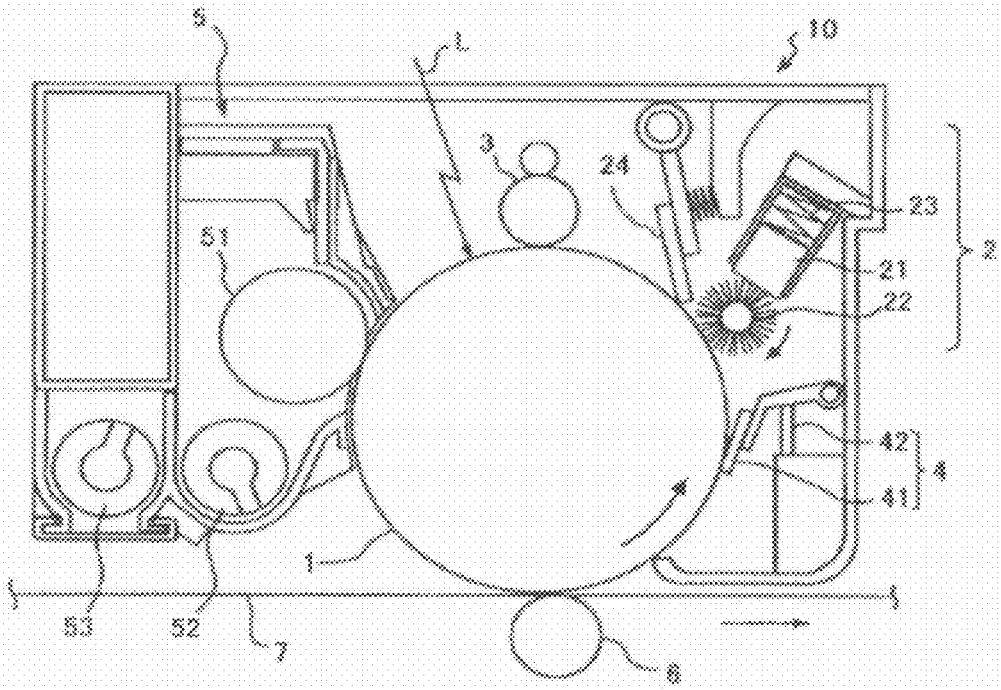
FIG. 4 is a schematic diagram showing one example of a process cartridge according to the present invention.

Here, FIG. 4 is a schematic diagram illustrating a process cartridge using a protective layer forming device according to the present invention.

In the process cartridge, a protective layer forming device 2, which is disposed so as to face a photoconductor drum 1 serving as a photoconductor, is composed of a protective agent block 21, a protective agent-supplying unit 22, a pressing force applying member 23, a thin-layer forming unit 24, and the like.

On a surface of the photoconductor drum 1, there are residues of protective agent partially deteriorated after transfer process and toner components, and the residues are removed by a cleaning unit 4, which is composed of a cleaning member 41, a cleaning-pressing mechanism 42 and the like.

In FIG. 4, the cleaning member 41 is in contact with the surface of the photoconductor drum 1 at an angle belonging to a so-called counter type (leading type).

The surface of the photoconductor drum 1, from which the residues of deteriorated protective agent and toner component have been removed, is supplied with a protective agent 21 from the protective agent-supplying unit 22, and a protective layer in the form of a film is produced on the photoconductor surface by the thin-layer forming unit 24. In the formation of the protective layer, the protective agent used in the present invention can be supplied in a required amount to a photoconductor surface with excellent controllability in a stable manner, and thus it can efficiently protect the photoconductor surface and prevent the photoconductor itself from deteriorating over a long period of time.

In FIG. 4, the thin-layer forming unit 24 is arranged in a trading direction of the photoconductor drum 1, however, it may be mounted in a counter direction with respect to the rotational direction of the photoconductor drum 1. Particularly when the linear velocity of the photoconductor is as high as 250 mm/sec or higher, it is preferable to mount it in the counter direction, because a protective layer can be formed in a short time.

In the image forming apparatus of the present invention, a metal soap can be applied uniformly and completely onto a photoconductor at any linear velocity of the photoconductor, however, at a linear velocity of 250 mm/sec or higher, further at a linear velocity of 450 mm/sec or higher, it is impossible to apply the metal soap onto the photoconductor uniformly and completely, unless the photoconductor is adapted to have a configuration of the present invention.

On the photoconductor on which surface a protective layer has been formed and has undergone charging, a latent electrostatic image is formed by an exposure light L, the latent electrostatic image is developed by the developing device 5 to be a visible image, and the visible image is transferred onto a recording medium 7 by a transfer roller 6 or the like disposed outside the process cartridge.

Since the process cartridge of the present invention, as described above, is superior in an allowable range with respect to the variance of the surface state of the photoconductor and has a configuration to highly control a change of chargeability onto the photoconductor, use of the process cartridge in combination with the toner described above makes it possible to form an extremely high-quality image for a long period of time.

EXAMPLES

Hereinafter, the present invention will be further described in detail with reference to Examples of the present invention, however, the present invention is not limited the disclosed ones.

Production Example 1

-Production of Protective Agent Block 1-

Zinc stearate was heated to 145° C. to be melted, and the melt zinc stearate was poured into a molding die and cooled, thereby producing Protective Agent Block 1 (size: 12 mm×8 mm×length: 350 mm).

Production Example 2

-Production of Protective Agent Block 2-

Stearic acid and palmitic acid were mixed at a mass ratio of 65:35 to prepare a mixture, and zinc hydroxide was mixed and melted with the resulting mixture to be reacted therewith, and then dried to produce particles in which zinc stearate and palmitic acid were dissolved in each other (particle diameter: 11 μm to 23 μm). A part of the particles thus produced was dissolved in a hydrochloric acid-methanol solution, and the product was heated to 80° C. to methylate the stearic acid and palmitic acid. The methylation product was analyzed by gas chromatography to determine the zinc stearate content and the palmitic acid content and to express them in terms of the equivalent ratio of zinc stearate to zinc palmitate, and the ratio was found to be 64:34 (mass ratio).

Protective Agent Block 2 was produced in the same manner as in Production Example 1 except that the zinc stearate-zinc palmitate particles thus produced were used.

Production Example 3

-Production of Protective Agent Block 3-

The zinc stearate-zinc palmitate particles produced in Production Example 2 were put into a compression-molding die, and ultrasonic vibration was applied to the compression-molding die to level off the zinc stearate-zinc palmitate particles.

Subsequently, the zinc stearate-zinc palmitate particles were compressed from above so as to have a thickness equivalent to 65% of the true specific gravity of the zinc stearate-zinc palmitate particles, the compression was stopped for 10 seconds, further compressed so as to have a thickness equivalent to 80% of the true specific gravity of the zinc stearate-zinc palmitate particles, the compression was stopped for 5 seconds, and finally compressed so as to have a thickness equivalent to 93% of the true specific gravity thereof, thereby producing Protective Agent Block 3 (size: 12 mm×8 mm×length: 350 mm).

Production Example 4

-Production of Protective Agent Block 4-

Zinc stearate particles having an average particle diameter of 20 μm and zinc palmitate particles having an average particle diameter of 120 μm were mixed at a mass ratio of 76:24 to prepare a mixture, and the mixture was put into a compression-molding die, and ultrasonic vibration was applied to the compression-molding die to level off the zinc stearate-zinc palmitate particles.

Subsequently, the zinc stearate-zinc palmitate particles were compressed from above so as to have a thickness equivalent to 65% of the true specific gravity of the zinc stearate-zinc palmitate particles, the compression was stopped for 5 seconds, further compressed so as to have a thickness equivalent to 82% of the true specific gravity of the zinc stearate-zinc palmitate particles, the compression was stopped for 5 seconds, and finally compressed so as to have a thickness equivalent to 92% of the true specific gravity thereof, thereby producing Protective Agent Block 4 (size: 12 mm×8 mm×length: 350 mm).

Production Example 5

-Production of Protective Agent Block 5-

Stearic acid and palmitic acid were mixed at a mass ratio of 50:50 to prepare a mixture, and zinc hydroxide was mixed and melted with the resulting mixture to be reacted therewith, and then dried to produce particles in which zinc stearate and palmitic acid were dissolved in each other (particle diameter: 11 μm to 23 μm). A part of the particles thus produced was dissolved in a hydrochloric acid-methanol solution, and the product was heated to 80° C. to methylate the stearic acid and palmitic acid. The methylation product was analyzed by gas chromatography to determine the zinc stearate content and the palmitic acid content and to express them in terms of the equivalent ratio of zinc stearate to zinc palmitate, and the ratio was found to be 48:52 (mass ratio).

The zinc stearate-zinc palmitate particles thus obtained were sieved to obtain particles having an average particle diameter of 18 μm and particles having an average particle diameter of 80 μm, and these different size particles were mixed at a mass ratio of 80:20.

Subsequently, the zinc stearate-zinc palmitate particles were compressed from above so as to have a thickness equivalent to 65% of the true specific gravity of the zinc stearate-zinc palmitate particles, the compression was stopped for 5 seconds, further compressed so as to have a thickness equivalent to 82% of the true specific gravity of the zinc stearate-zinc palmitate particles, the compression was stopped for 5 seconds, and finally compressed so as to have a thickness equivalent to 96% of the true specific gravity thereof, thereby producing Protective Agent Block 5 (size: 12 mm×8 mm×length: 350 mm).

Production Example 6

-Production of Protective Agent Block 6-

The zinc stearate-zinc palmitate particles produced in Production Example 5 were sieved to obtain particles having an average particle diameter of 35 μm and particles having an average particle diameter of 180 μm, and these different size particles were mixed at a mass ratio of 80:20.

Subsequently, the zinc stearate-zinc palmitate particles were compressed from above so as to have a thickness equivalent to 65% of the true specific gravity of the zinc stearate-zinc palmitate particles, the compression was stopped for 5 seconds, further compressed so as to have a thickness equivalent to 82% of the true specific gravity of the zinc stearate-zinc palmitate particles, the compression was stopped for 5 seconds, and finally compressed so as to have a thickness equivalent to 96% of the true specific gravity thereof, thereby producing Protective Agent Block 6 (size: 12 mm×8 mm×length: 350 mm).

Production Example 7

-Production of Protective Agent Block 7-

Zinc stearate-zinc palmitate particles were produced so that zinc stearate and palmitic acid were mixed at a mass ratio of 58:42 and dissolved in each other, and the particles were sieved to obtain particles having an average particle diameter of 28 μm and particles having an average particle diameter of 55 μm.

These different size particles were mixed at a mass ratio of 50:50, the mixed particles were further mixed with 19% by mass of boron nitride having a primary particle diameter of 0.3 μm and 3% by mass of alumina particles having a particle diameter of 0.31 μm by a blender, the resulting mixed particles were put into a compression-molding die, and ultrasonic vibration was applied to the compression-molding die to level off the zinc stearate-zinc palmitate particles.

Subsequently, the zinc stearate-zinc palmitate particles were compressed from above so as to have a thickness equivalent to 67% of the true specific gravity of the zinc stearate-zinc palmitate particles, the compression was stopped for 5 seconds, further compressed so as to have a thickness equivalent to 94% of the true specific gravity of the zinc stearate-zinc palmitate particles, thereby producing Protective Agent Block 7 (size: 9 mm×8 mm×length: 350 mm).

Production Example 8

-Production of Protective Agent Block 8-

The mixed zinc stearate-zinc palmitate particles used in Production Example 7 were further mixed with 17% by mass of boron nitride having a primary particle diameter of 0.5 μm and 2% by mass of alumina particles having a particle diameter of 0.28 μm by a blender, the resulting mixed particles were put into a compression-molding die, and ultrasonic vibration was applied to the compression-molding die to level off the zinc stearate-zinc palmitate particles.

Subsequently, the zinc stearate-zinc palmitate particles were compressed from above so as to have a thickness equivalent to 67% of the true specific gravity of the zinc stearate-zinc palmitate particles, the compression was stopped for 5 seconds, further compressed so as to have a thickness equivalent to 94% of the true specific gravity of the zinc stearate-zinc palmitate particles, thereby producing Protective Agent Block 8 (size: 9 mm×8 mm×length: 350 mm).

Production Example 9

-Production of Photoconductor 1-

Over an aluminum drum (conductive support) having a diameter of 40 mm, an undercoat layer-coating liquid, a charge generating layer-coating liquid, a charge transporting layer-coating liquid and a protective layer-coating liquid each having the following composition were applied in this order, and then dried to thereby produce a photoconductor including an undercoat layer of 4.2 μm in thickness, a charge generating layer of 0.15 μm in thickness, a charge transporting layer of 21 μm in thickness, and a protective layer of 4.6 μm in thickness. Note that the protective layer was formed by spray coating, and the other layers were formed by dip coating.

| [Undercoat Layer-Coating Liquid] | |
|---|---|
| alkyd resin (BECKOZOL 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| titanium oxide | 40 parts by mass |
| methylethylketone | 200 parts by mass |

| [Charge Generating Layer-Coating Liquid] | |
|---|---|
| Y-type oxotitanylphthalocyanine pigment | 2 parts by mass |
| polyvinylbutyral (ESLEC BM-S, produced by Sekisui Chemical Co. Ltd.) | 0.2 parts by mass |
| tetrahydrofuran | 50 parts by mass |

| [Charge Transporting Layer-Coating Liquid] | |
|---|---|
| bisphenol-A polycarbonate (PANLITE K1300, produced by Teijin Chemicals Ltd.) | 10 parts by mass |
| low-molecular-weight-charge transporting material represented by the following structural formula | 10 parts by mass |

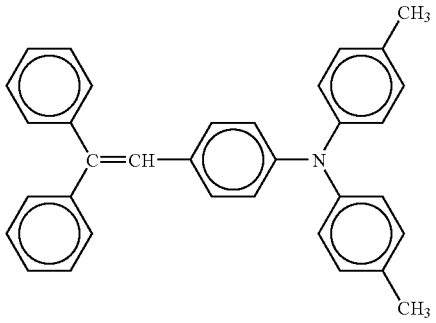

| | |
|---|---|
| methylene chloride | 100 parts by mass |

| [Protective Layer-Coating Liquid] | |
|---|---|
| polycarbonate | 10 parts by mass |
| low-molecular-weight-charge transporting material represented by the above structural formula | 7 parts by mass |
| alumina fine particles (central particle diameter: 0.30 μm) | 6 parts by mass |
| dispersion auxiliary agent (BYK-P104, produced by BykChemie Japan Co. Ltd.) | 0.08 parts by mass |
| tetrahydrofuran | 700 parts by mass |
| cyclohexanone | 200 parts by mass |

Production Example 10

-Production of Photoconductor 2-

Photoconductor 2 was produced in the same manner as in Production Example 9, except that 6 parts by mass of the alumina fine particles (central particle diameter: 0.30 μm) in the protective layer-coating liquid were changed to 6.1 parts by mass of alumina fine particles (central particle diameter: 0.32 μm).

Example 1

A tandem type color-image forming apparatus (IMAGIO MP C3500, manufactured by Ricoh Company Ltd.) was remodeled so that a protective layer-coating blade was disposed at an angle of counter to the surface of a photoconductor as shown in FIG. 3, the linear velocity of the photoconductor was set to 290 mm/sec, and a direct voltage of −600 V and an alternating current with an amplitude of 1.2 kV and a frequency of 2.1 kHz were applied to the photoconductor surface so as to be charged, by a charging roller.

From a process cartridge in the image forming apparatus, a cleaning blade, the coating blade, the charging roller and the photoconductor were removed, the protective agent block 3 was used and the photoconductor and a brush were allowed to rotate for 2 hours. Then, metal soap particles scraped by the brush were sampled, followed by observation by an electron microscope. Note that as the brush, a brush of acrylic resin fibers having a diameter of 28 μm was used.

Figure 5:
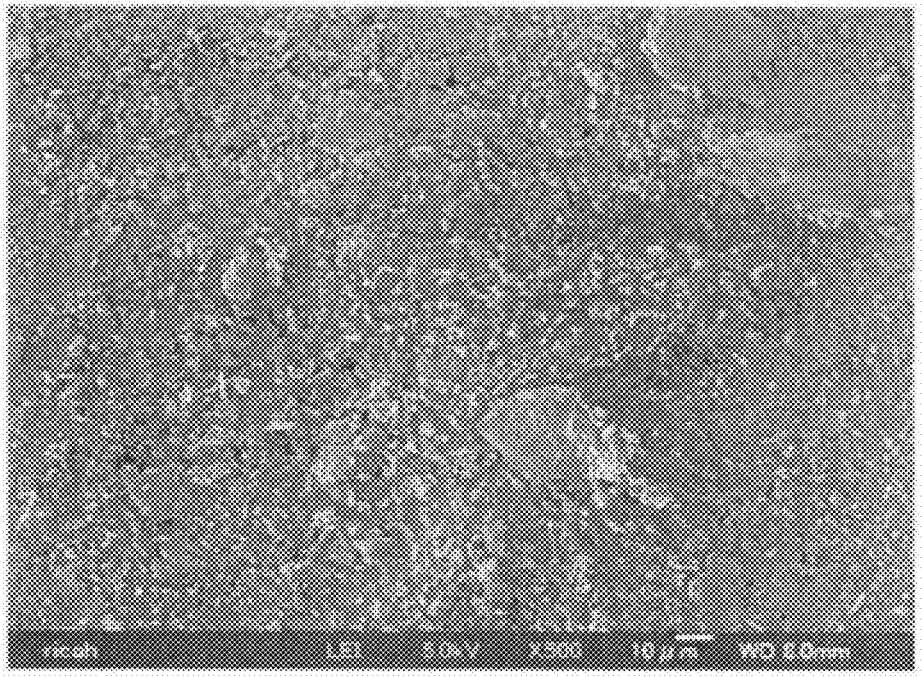
FIG. 5 is an electron microphotograph of metal soap particles produced in Example 1.

As shown in FIG. 5, metal soap particles having a maximum particle diameter of approximately 50 μm were observed. The metal soap particles having a maximum particle diameter of approximately 50 μm were found to be flat-shaped primary particles.

The sampled metal soap particles were measured for the amount of particles having a diameter of 20 μm to 200 μm by using a particle size distribution-measuring device (COULTER COUNTER MULTISIZER III, manufactured by Beckman Coulter Co.), and the amount of such particles was found to be 18% by mass.

Subsequently, four units of a process cartridge using the photoconductor 1, and the protective agent block 3 were produced, and mounted in the remodeled tandem-type image forming apparatus (IMAGIO MP C3500, manufactured by Ricoh Company Ltd.). A test chart with an image density of 7% was prepared, 22,000 sheets of image were formed on a five-sheet basis under the environment of 22° C. and a relative humidity of 40%. In other words, the image forming apparatus was started to form five sheets of image, the operation was stopped once, and then the image forming apparatus was restarted to form five sheets of image. This image formation process was repeated to form 22,000 image sheets in total. Thereafter, halftone images of yellow, cyan, magenta and black were output, the output print images were evaluated, and it was found that all the color images were halftone images with high-image quality.

Comparative Example 1

After the cleaning blade, the coating blade, the charging roller and the photoconductor were removed from the process cartridge, and the photoconductor and a brush were allowed to rotate for 2 hours, the procedure of Example 1 was repeated, except that the protective agent block 1 was used instead of the protective agent block 3. Then, metal soap particles scraped by the brush were sampled, followed by observation by an electron microscope. As the brush, a brush of acrylic resin fibers having a diameter of 28 μm was used.

Figure 6:
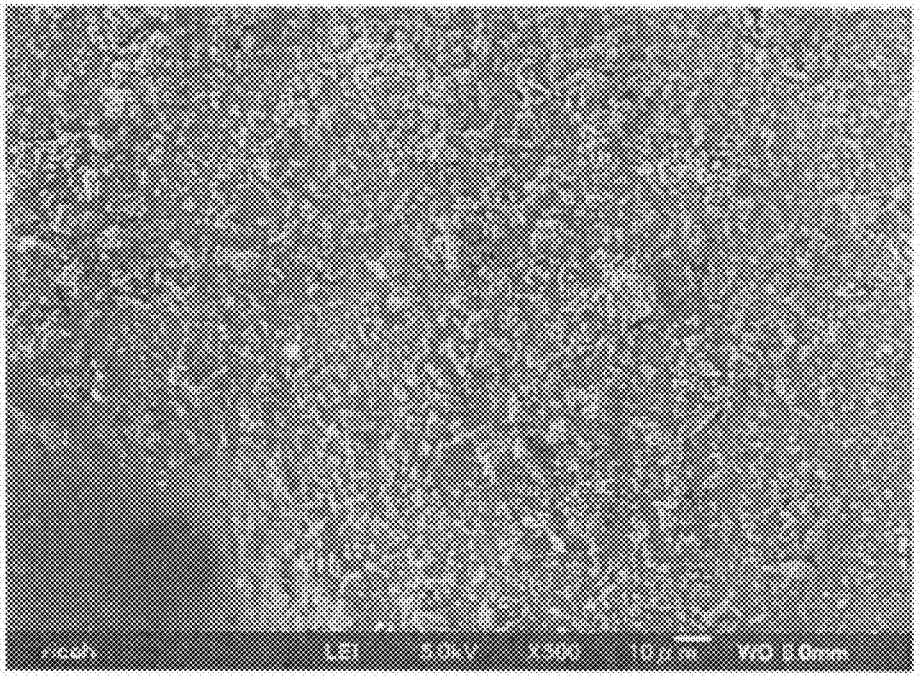
FIG. 6 is an electron microphotograph of metal soap particles produced in Comparative Example 1.

As shown in FIG. 6, it was found that metal soap particles having a diameter of 20 μm or greater were rarely present in the sampled particles.

The sampled metal soap particles were measured for the amount of particles having a diameter of 20 μm to 200 μm by using a particle size distribution-measuring device (COULTER COUNTER MULTISIZER III, manufactured by Beckman Coulter Co.), and the amount of such particles was found to be 0% by mass.

Subsequently, four units of a process cartridge using the photoconductor 1, and the protective agent block 1 were produced, and mounted in the remodeled tandem-type image forming apparatus (IMAGIO MP C3500, manufactured by Ricoh Company Ltd.). A test chart with an image density of 7% was prepared, 22,000 sheets of image were formed on a five-sheet basis under the environment of 22° C. and a relative humidity of 40%. In other words, the image forming apparatus was started to form five sheets of image, the operation was stopped once, and then the image forming apparatus was restarted to form five sheets of image. This image formation process was repeated to form 22,000 image sheets in total. Thereafter, halftone images of yellow, cyan, magenta and black were output, the output print images were evaluated, and fine-streaky abnormal images occurred in cyan, magenta and black color images, in particular, abnormal images were clearly observed in the magenta and black color images.

Example 2

The procedure of Example 1 was repeated, except that the protective agent block 2 was used instead of the protective agent block 3, and as the brush, a brush was used, which had been prepared by electrostatic flocking nylon fibers having a diameter of 36 μm and acrylic resin fibers having a diameter of 25 μm at a ratio of 3:7 (mass ratio). Metal soap particles scraped by the brush were sampled, the sampled metal soap particles were measured by using a particle size distribution-measuring device (COULTER COUNTER MULTISIZER III, manufactured by Beckman Coulter Co.), and found to have a maximum particle diameter of 34 μm and include particles having a particle diameter of 20 μm to 200 μm in an amount of 1.2% by mass.

Subsequently, the photoconductor 1 and the protective agent block 2 were used to produce an image forming apparatus and image formation was carried out in the same manner as in Example 1. It was found that all the color images were formed with high-mage quality.

Example 3

A tandem type color-image forming apparatus (IMAGIO MP C3500, manufactured by Ricoh Company Ltd.) was remodeled so that a protective layer-coating blade was disposed at an angle of counter to the surface of a photoconductor as shown in FIG. 3, the linear velocity of the photoconductor was set to 170 mm/sec, and a direct voltage of −600 V and an alternating current with an amplitude of 1.2 kV and a frequency of 1.5 kHz were applied to the photoconductor surface so as to be charged, by a charging roller.

The procedure of Example 1 was repeated, except that the process cartridge in this image forming apparatus and the protective agent block 4 were used, and as the brush, a brush (carbon-mixed acrylic resin fibers having a diameter of 26 μm) was used. Metal soap particles scraped by the brush were sampled, the sampled metal soap particles were measured by using a particle size distribution-measuring device (COULTER COUNTER MULTISIZER III, manufactured by Beckman Coulter Co.), and found to have a maximum particle diameter of 190 μm and include particles having a particle diameter of 20 μm to 200 μm in an amount of 48% by mass.

Subsequently, four units of a process cartridge using the photoconductor 1, and the protective agent block 4 were produced, and mounted in the remodeled tandem-type image forming apparatus (IMAGIO MP C3500, manufactured by Ricoh Company Ltd.). A test chart with an image density of 12% was prepared, 20,000 sheets of image were formed in total on a five-sheet basis under the environment of 20° C. and a relative humidity of 45%.

Thereafter, halftone images of yellow, cyan, magenta and black were output, the output print images were evaluated, and the images of yellow, cyan and magenta colors were formed with high-image quality but in the image of black color, streaks were slightly observed when stared.

Comparative Example 2

The procedure of Example 3 was repeated, except that the protective agent block 1 was used instead of the protective agent block 4. Then, metal soap particles scraped by a brush (carbon-mixed acrylic resin fibers having a diameter of 26 μm) were sampled, the sampled metal soap particles were measured by using a particle size distribution-measuring device (COULTER COUNTER MULTISIZER III, manufactured by Beckman Coulter Co.) and found to include particles having a particle diameter of 20 μm to 200 μm in an amount of 0% by mass.

Subsequently, four units of a process cartridge using the photoconductor 1, and the protective agent block 1 were produced, and mounted in the remodeled tandem-type image forming apparatus (IMAGIO MP C3500, manufactured by Ricoh Company Ltd.). A test chart with an image density of 12% was prepared, 20,000 sheets of image were formed in total on a five-sheet basis under the environment of 20° C. and a relative humidity of 45%.

Thereafter, halftone images of yellow, cyan, magenta and black were output, the output print images were evaluated.

Streaky abnormal images were found in the all the color images, and in particular, the image of black color was evaluated "unacceptable".

Example 4

A tandem type color-image forming apparatus (IMAGIO MP C3500, manufactured by Ricoh Company Ltd.) was remodeled so that a protective layer-coating blade was disposed at an angle of counter to the surface of a photoconductor as shown in FIG. 3, the linear velocity of the photoconductor was set to 455 mm/sec, and a direct voltage of −600 V and an alternating current with an amplitude of 1.5 kV and a frequency of 4.5 kHz were applied to the photoconductor surface so as to be charged, by a charging roller.

The procedure of Example 1 was repeated, except that the process cartridge in this image forming apparatus and the protective agent block 5 were used, and as the brush, a brush (carbon-mixed acrylic resin fibers having a diameter of 26 μm) was used. Metal soap particles scraped by the brush were sampled, the sampled metal soap particles were measured by using a particle size distribution-measuring device (COULTER COUNTER MULTISIZER III, manufactured by Beckman Coulter Co.), and found to have a maximum particle diameter of 140 μm and include particles having a particle diameter of 20 μm to 200 μm in an amount of 23% by mass.

Subsequently, four units of a process cartridge using the photoconductor 2, and the protective agent block 5 were produced, and mounted in the remodeled tandem-type image forming apparatus (IMAGIO MP C3500, manufactured by Ricoh Company Ltd.). A test chart with an image density of 12% was prepared, 70,000 sheets of image were formed in total on a five-sheet basis under the environment of 20° C. and a relative humidity of 40%.

Thereafter, halftone images of yellow, cyan, magenta and black were output, the output print images were evaluated, and it was found that all the color images were formed with high-image quality.

Comparative Example 3

The procedure of Example 4 was repeated, except that the protective agent block 6 was used instead of the protective agent block 5. Then, metal soap particles scraped by a brush (carbon-mixed acrylic resin fibers having a diameter of 26 μm) were sampled, the sampled metal soap particles were measured by using a particle size distribution-measuring device (COULTER COUNTER MULTISIZER III, manufactured by Beckman Coulter Co.) and found to have a maximum particle diameter of 230 μm and include particles having a particle diameter of 20 μm to 200 μm in an amount of 73% by mass.

Subsequently, four units of a process cartridge using the photoconductor 2, and the protective agent block 6 were produced, and mounted in the remodeled tandem-type image forming apparatus (IMAGIO MP C3500, manufactured by Ricoh Company Ltd.). A test chart with an image density of 12% was prepared, 70,000 sheets of image were formed in total on a five-sheet basis under the environment of 20° C. and a relative humidity of 40%.

Thereafter, halftone images of yellow, cyan, magenta and black were output, the output print images were evaluated. As a result, streaks were observed in all the color images. In particular, the images of magenta and black were magnified and observed by a microscope, and found to have some portions where image deletion occurred.

Comparative Example 4

The procedure of Example 4 was repeated, except that the protective agent block 1 was used instead of the protective agent block 5. Then, metal soap particles scraped by a brush (carbon-mixed acrylic resin fibers having a diameter of 26 μm) were sampled, the sampled metal soap particles were measured by using a particle size distribution-measuring device (COULTER COUNTER MULTISIZER III, manufactured by Beckman Coulter Co.) and found to include particles having a particle diameter of 20 μm to 200 μm at 0% by mass.

Subsequently, four units of a process cartridge using the photoconductor 2, and the protective agent block 1 were produced, and mounted in the remodeled tandem-type image forming apparatus (IMAGIO MP C3500, manufactured by Ricoh Company Ltd.). A test chart with an image density of 12% was prepared, 70,000 sheets of image were formed in total on a five-sheet basis under the environment of 20° C. and a relative humidity of 40%.

Thereafter, halftone images of yellow, cyan, magenta and black were output, the output print images were evaluated. As a result, streaks were observed in all the color images.

Example 5

The procedure of Example 4 was repeated, except that the protective agent block 7 was used instead of the protective agent block 5. Then, metal soap particles scraped by a brush (carbon-mixed acrylic resin fibers having a diameter of 26 μm) were sampled, the sampled metal soap particles were measured by using a particle size distribution-measuring device (COULTER COUNTER MULTISIZER III, manufactured by Beckman Coulter Co.) and found to have a maximum particle diameter of 120 μm and include particles having a particle diameter of 20 μm to 200 μm in an amount of 44% by mass.

Subsequently, with use of the photoconductor 2 and the protective agent block 7, image formation was carried out in the same manner as in Example 4. As a result, it was found that all the color images were formed with high-image quality.

Example 6

The procedure of Example 4 was repeated, except that the protective agent block 8 was used instead of the protective agent block 5. Then, metal soap particles scraped by a brush (carbon-mixed acrylic resin fibers having a diameter of 26 μm) were sampled, the sampled metal soap particles were measured by using a particle size distribution-measuring device (COULTER COUNTER MULTISIZER III, manufactured by Beckman Coulter Co.) and found to have a maximum particle diameter of 110 μm and include particles having a particle diameter of 20 μm to 200 μm in an amount of 28% by mass.

Subsequently, with use of the photoconductor 2 and the protective agent block 8, image formation was carried out in the same manner as in Example 4. As a result, it was found that all the color images were formed with high-image quality.

An image forming apparatus equipped with the protective layer forming device of the present invention which is capable of protecting the surface of a photoconductor even when the photoconductor has a high-linear velocity, and which is capable of forming a high-quality image without causing black streaks due to increased electric resistance of a charging roller used in the apparatus. Therefore, the image forming apparatus can be favorably used in electrophotographic image forming methods, and the protective layer forming device can be favorably used in electrophotographic image forming methods, electrophotographic image forming apparatuses and electrophotographic process cartridges.

What is claimed is:

1. A protective layer forming device comprising:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

2. The protective layer forming device according to claim 1, wherein the metal soap is a mixture of zinc stearate and zinc palmitate.

3. The protective layer forming device according to claim 1, wherein the linear velocity of the photoconductor at the time of the protective agent in the form of a fine powder being supplied is 250 mm/sec or higher.

4. The protective layer forming device according to claim 1, further comprising a thin-layer forming unit configured to form the protective agent supplied onto the photoconductor into a thin layer.

5. The protective layer forming device according to claim 1, wherein the protective agent in the form of a fine powder has a particle diameter of 20 μm to 200 μm and is formed of flat-shaped primary particles.

6. The protective layer forming device according to claim 1, wherein the protective agent block is formed so that the protective agent containing the metal soap is compressed 85% to 98% with respect to a specific gravity of the entire protective agent.

7. An image forming apparatus comprising:

a photoconductor, a latent electrostatic image forming unit configured to form a latent electrostatic image on the photoconductor, a developing unit configured to develop the latent electrostatic image using a toner to form a visible image, a transfer unit configured to transfer the visible image onto a recording medium, a protective layer forming unit, and a fixing unit configured to fix the transferred image on the recording medium, wherein the protective layer forming unit comprises:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

8. A process cartridge adapted to be detachably mounted on a main body of an image forming apparatus, comprising:

a photoconductor, a developing unit configured to develop a latent electrostatic image using a toner to form a visible image on the photoconductor, and a protective layer forming unit, wherein the protective layer forming unit comprises:

a protective agent block containing a metal soap, a protective agent supplying unit configured to supply a protective agent onto a photoconductor, and a pressing unit configured to press the protective agent supplying unit against the protective agent block, wherein the protective agent supplying unit is rotated while being pressed against the protective agent block by the pressing unit, so that the protective agent block is micronized to make the protective agent in the form of a fine powder, and the protective agent in the form of a fine powder is supplied onto the photoconductor, thereby forming a protective layer on the photoconductor, and wherein the protective agent in the form of a fine powder has a particle diameter of 200 μm or smaller and contains protective agent particles of 20 μm to 200 μm in an amount of 1% by mass to 70% by mass.

* * * * *